US008220098B2

(12) United States Patent
Wilkins

(10) Patent No.: US 8,220,098 B2
(45) **Date of Patent: *Jul. 17, 2012**

(54) PORTABLE SCRUBBER WITH LIQUID DISPENSER CARTRIDGE

(76) Inventor: Larry C. Wilkins, Fort Lauderdale, FL (US)

( * ) Notice: Subject to any disclaimer, the term of this patent is extended or adjusted under 35 U.S.C. 154(b) by 932 days.

This patent is subject to a terminal disclaimer.

(21) Appl. No.: 12/090,438

(22) PCT Filed: Oct. 16, 2006

(86) PCT No.: PCT/US2006/040551

§ 371 (c)(1),
(2), (4) Date: Jul. 28, 2008

(87) PCT Pub. No.: WO2007/047672

PCT Pub. Date: Apr. 26, 2007

(65) Prior Publication Data

US 2009/0217470 A1 Sep. 3, 2009

Related U.S. Application Data

(63) Continuation-in-part of application No. 11/254,647, filed on Oct. 20, 2005, now Pat. No. 7,703,165.

(60) Provisional application No. 60/799,692, filed on May 11, 2006.

(51) Int. Cl.
*A46B 3/06* (2006.01)

(52) U.S. Cl. ..... 15/24; 15/29; 15/97.1; 137/268; 222/133; 222/167; 222/169; 239/310; 415/167; 415/202; 422/270

(58) Field of Classification Search ..... 15/24, 29, 15/50.1, 50.3, 52, 69, 97.1, 98, 103.5; 137/268; 222/133, 160, 167, 169; 239/231, 236, 247, 239/310; 401/40–43, 219, 289, 281; 415/151, 415/167, 202; 422/270

See application file for complete search history.

(56) References Cited

U.S. PATENT DOCUMENTS

| | | | | | |
|---|---|---|---|---|---|
| 392,730 | A | * | 11/1888 | Howard | 415/167 |
| 518,352 | A | | 4/1894 | Nightingale | |
| 648,856 | A | * | 5/1900 | Deemer | 15/24 |
| 843,377 | A | | 2/1907 | Ullrich et al. | |
| 847,060 | A | * | 3/1907 | Gamache | 15/29 |
| 1,017,606 | A | * | 2/1912 | Tool et al. | 15/24 |
| 1,047,729 | A | * | 12/1912 | Beardsley | 401/4 |
| 1,154,349 | A | * | 9/1915 | Tanaka | 401/41 |
| 1,228,897 | A | * | 6/1917 | Frame | 415/167 |
| 1,369,567 | A | * | 2/1921 | Smith | 15/29 |
| 1,392,623 | A | * | 10/1921 | Cheatham | 15/29 |
| 1,414,605 | A | | 5/1922 | Tolookjian | |

(Continued)

*Primary Examiner* — Mark Spisich
(74) *Attorney, Agent, or Firm* — Finnegan, Henderson, Farabow, Garrett & Dunner, L.L.P.

(57) ABSTRACT

A portable cleaning apparatus includes a handle (11) and a wheel (13) rotatably mounted to the handle and the wheel having a plurality of scrubbing elements (74). Pressurized fluid enters the apparatus and a fluid flow director (16) delivers the fluid to the scrubbing elements to rotate the wheel. The scrubbing elements can be secured to the wheel to limit pivoting movement of the scrubbing elements in a direction of rotation of the wheel while permitting greater pivoting movement of the scrubbing elements in direction opposite the direction of rotation of the wheel. Different types of treatment material dispensing systems (100) are operable position a flow director to spin a dispenser of treatment material, or to position a dispenser in the rotational path of the scrubbing elements, to apply treatment material to the scrubbing elements.

28 Claims, 30 Drawing Sheets

U.S. PATENT DOCUMENTS

| | | | | | |
|---|---|---|---|---|---|
| 1,423,844 | A | | 7/1922 | Fenelon | |
| 1,461,620 | A | * | 7/1923 | Knapp | 15/29 |
| 1,476,433 | A | * | 12/1923 | Vandervoort | 15/22.1 |
| 1,550,187 | A | * | 8/1925 | Vara | 15/24 |
| 1,679,561 | A | | 8/1928 | Cantrell | |
| 1,691,524 | A | * | 11/1928 | Maycen | 15/24 |
| 1,817,644 | A | | 8/1931 | Pope | |
| 1,841,414 | A | | 1/1932 | McBride | |
| 1,910,235 | A | | 5/1933 | Burkett | |
| 2,019,705 | A | * | 11/1935 | Hubert | 15/74 |
| 2,142,947 | A | | 1/1939 | Kretzschmar et al. | |
| 2,723,407 | A | | 11/1955 | Bardon | |
| 3,199,957 | A | | 8/1965 | Vivion | |
| 3,599,267 | A | | 8/1971 | Faires | |
| 3,748,678 | A | | 7/1973 | Ballou | |
| 4,154,258 | A | | 5/1979 | Duda et al. | |
| 4,461,052 | A | | 7/1984 | Mostul | |
| 4,581,785 | A | | 4/1986 | Suzuki | |
| 4,780,922 | A | | 11/1988 | Sanchez | |
| 4,780,992 | A | | 11/1988 | McKervey | |
| 5,146,642 | A | | 9/1992 | Mank et al. | |
| 5,235,717 | A | | 8/1993 | Lanzo, Jr. et al. | |
| 5,301,472 | A | | 4/1994 | Lyng | |
| 5,987,622 | A | | 11/1999 | Rossi | |
| 6,068,204 | A | | 5/2000 | Alexander | |
| 6,582,668 | B2 | | 6/2003 | Green | |
| 6,594,843 | B1 | | 7/2003 | Wilkins | |
| 6,792,639 | B2 | | 9/2004 | Wilkins | |
| 6,814,306 | B1 | | 11/2004 | Okubo | |
| 7,011,254 | B2 | | 3/2006 | Thornton | |

* cited by examiner

PORTABLE SCRUBBER WITH LIQUID DISPENSER CARTRIDGE

REFERENCE TO RELATED APPLICATIONS

This application is a National Stage application of International Application No. PCT/US2006/040551 filed Oct. 16, 2006 (which was published in English), which is a continuation-in-part of U.S. patent application Ser. No. 11/254,647 filed Oct. 20, 2005, now U.S. Pat. No. 7,703,165, and the benefit of U.S. Provisional Patent Application No. 60/799,692 filed May 11, 2006, each of which is hereby incorporated by reference in its entirety.

BACKGROUND

Devices for cleaning or preparing surfaces have been provided. Such devices have included rotary brushes that are propelled by fluid delivered thereto through the device. The rotary force provided by directing fluid to the brush can encounter resistance when other portions of the brush are positioned against a treatment surface, preventing the brush from rotating effectively along the treatment surface. It may further be desirable to deliver treatment material to treat the surface being cleaned. The ability to deliver the treatment material at the desired time and in the desired amount without stopping cleaning of the treatment surface can improve efficiencies in cleaning the treatment surface and reduce waste of treatment material

SUMMARY

Described briefly, an illustrated embodiment includes a handle with a fitting for connection to an external pressurized water or other fluid supply; a rotatable wheel at an end of the handle having surface scrubbing elements thereon; and a nozzle to direct high velocity of fluid discharge onto the wheel.

In one embodiment, the scrubbing elements can be configured to receive the fluid on a first side thereof while maintaining a generally radial orientation relative to the wheel and to pivot from the generally radial orientation when a second side thereof encounters a treatment surface.

In another embodiment, a dispensing system is provided that is operable to move a dispenser of treatment material from a first position outside the rotary path of the scrubbing elements to a second position in the path of the scrubbing elements to deliver treatment material to respective scrubbing elements passing thereby and which treatment material is thereafter delivered to the treatment surface by the scrubbing elements.

Other embodiments use a readily replaceable disposable dispenser cartridge containing liquid treatment material, and with the nozzle adjustable to control the rate of rotation of the cartridge for dispensing treatment material.

These and other embodiments may involve a high pressure washer device coupled to the handle fitting for supply of highly-pressurized water or other fluid.

The foregoing illustrated embodiments are portable. Further embodiments, forms, features, aspects, benefits, objects, and advantages of the present invention shall become apparent from the detailed description and figures provided herewith.

DETAILED DESCRIPTION OF SELECTED EMBODIMENTS

Figure 1:
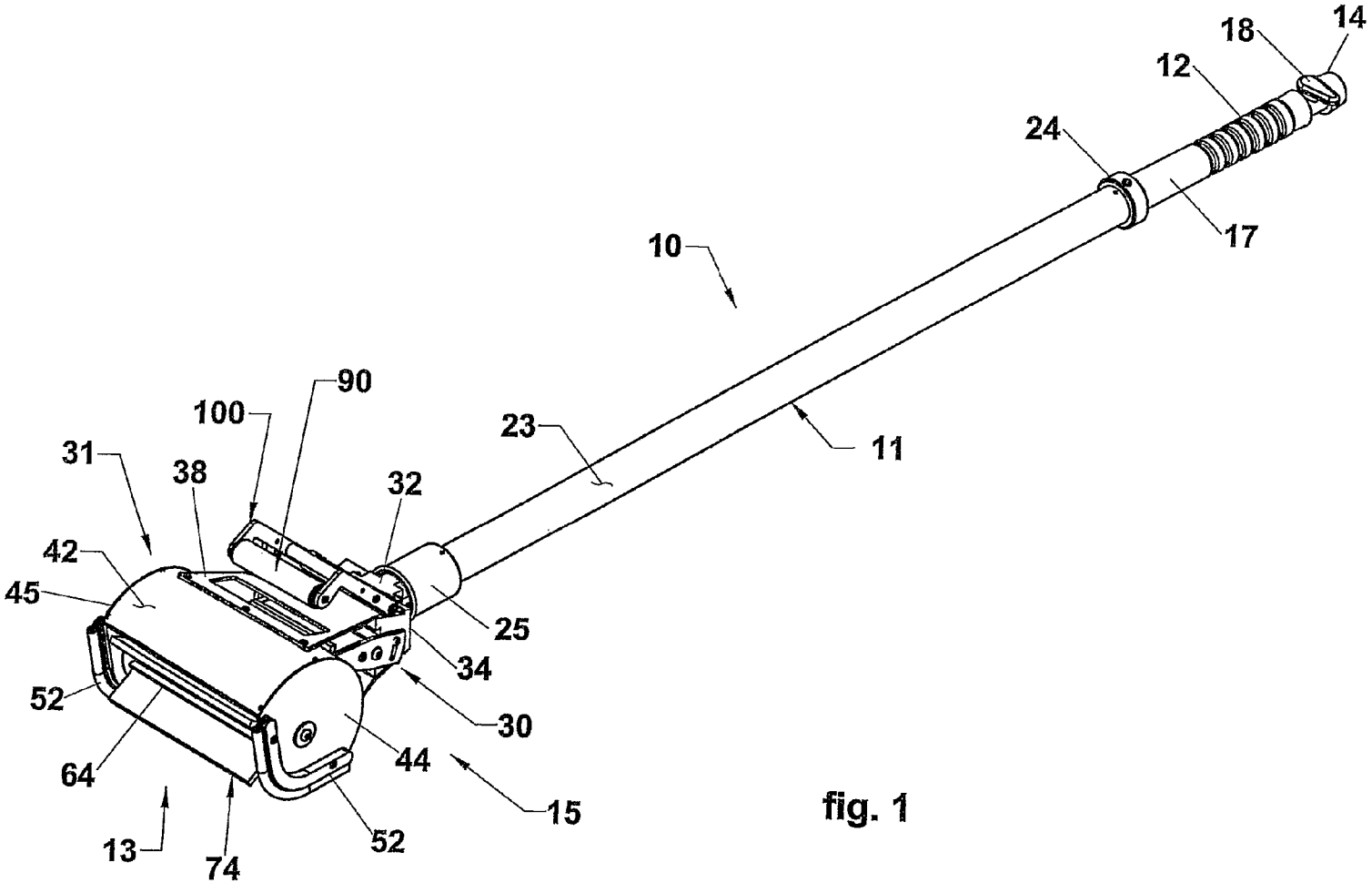
FIG. 1 is a perspective view of a portable scrubbing apparatus looking toward its distal end.

For the purpose of promoting an understanding of the principles of the invention, reference will now be made to the embodiments illustrated in the drawings and specific language will be used to describe the same. It will nevertheless be understood that no limitation of the scope of the invention is thereby intended. Any alterations and further modifications in the described embodiments, and any further applications of the principles of the invention as described herein are contemplated as would normally occur to one skilled in the art to which the invention relates.

Figure 2:
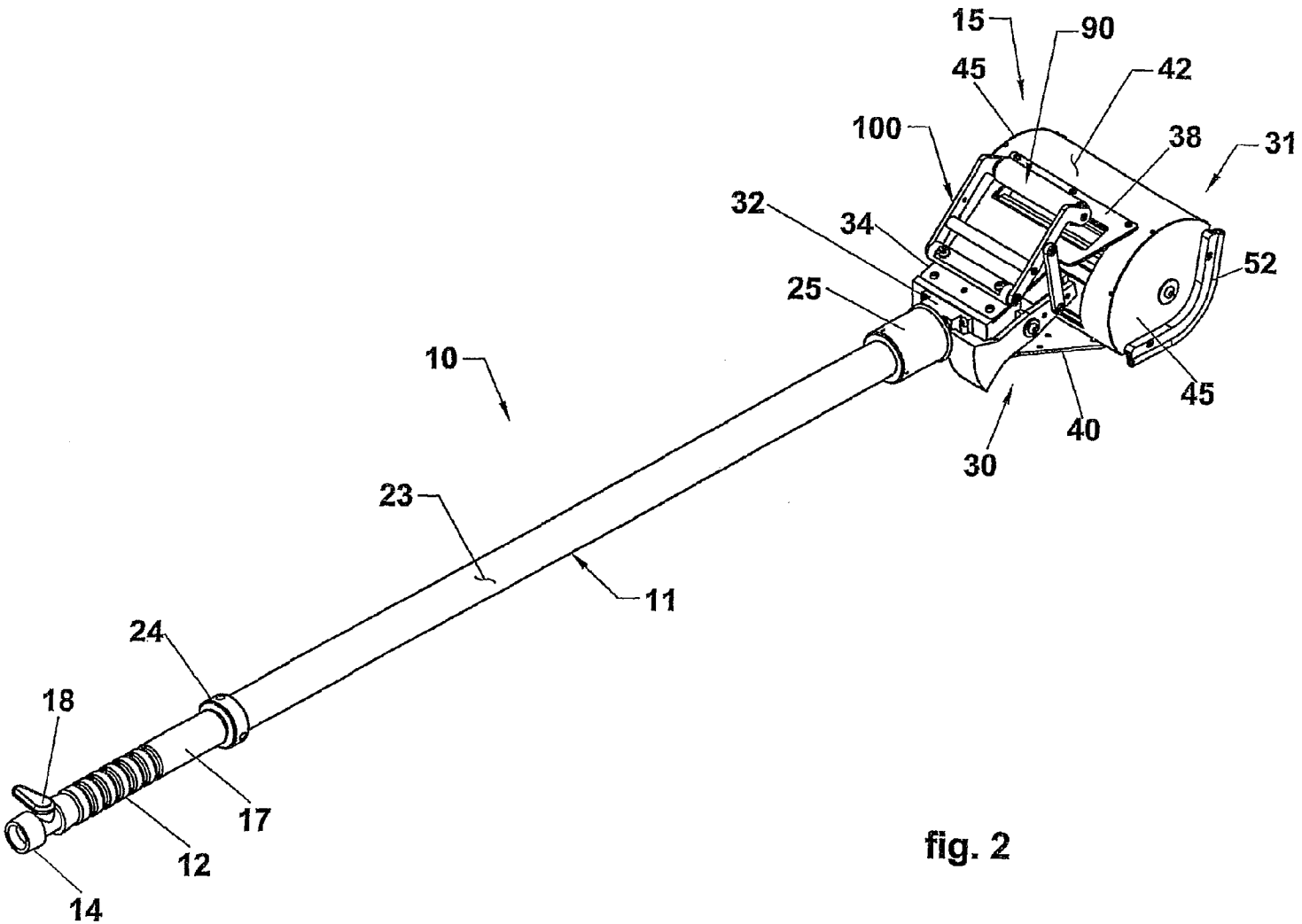
FIG. 2 is a perspective view of the portable scrubbing apparatus of FIG. 1 looking toward its proximal end.
Figure 3:
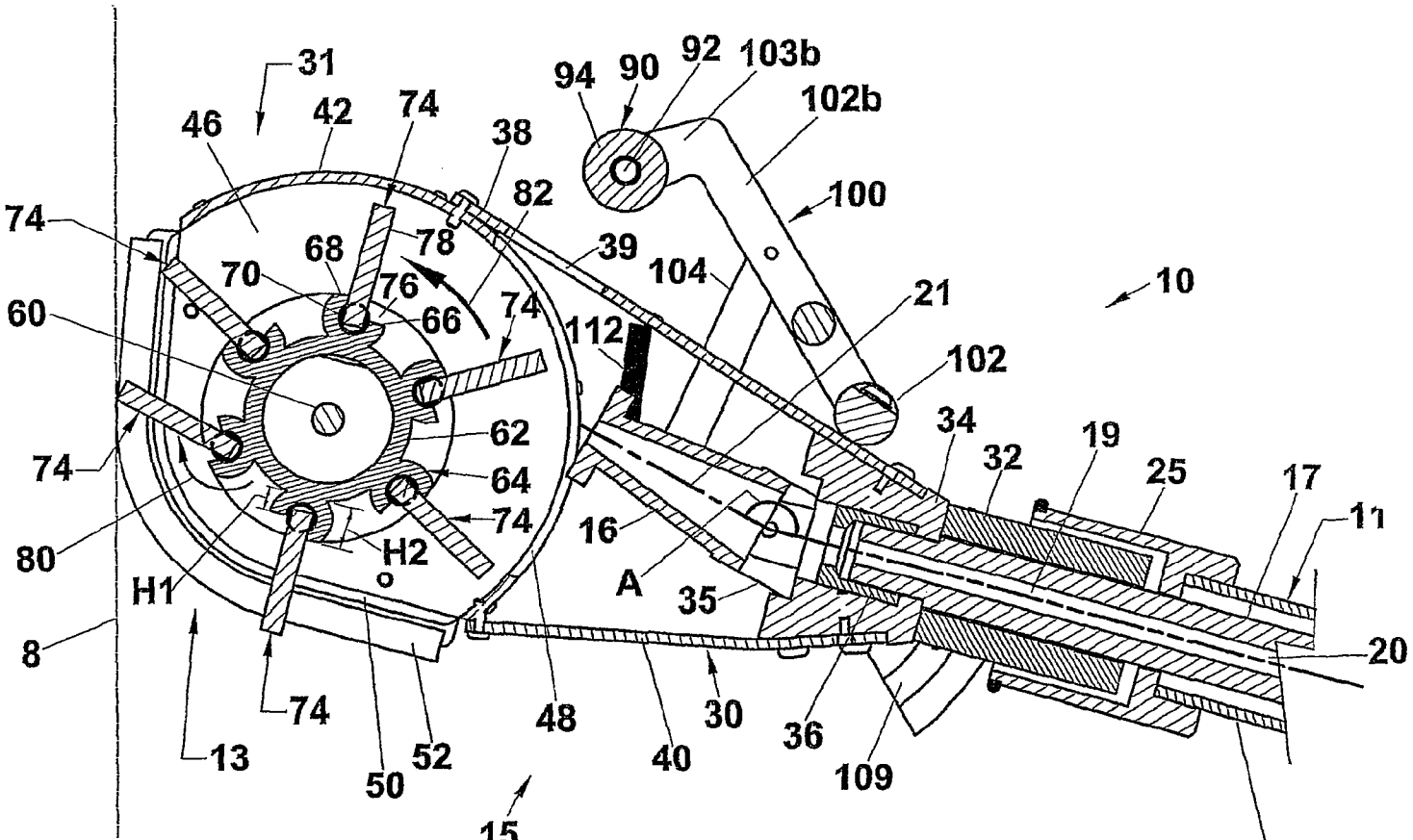
FIG. 3 is a longitudinal sectional view of a distal portion of the portable scrubbing apparatus of FIG. 1.
Figure 4:
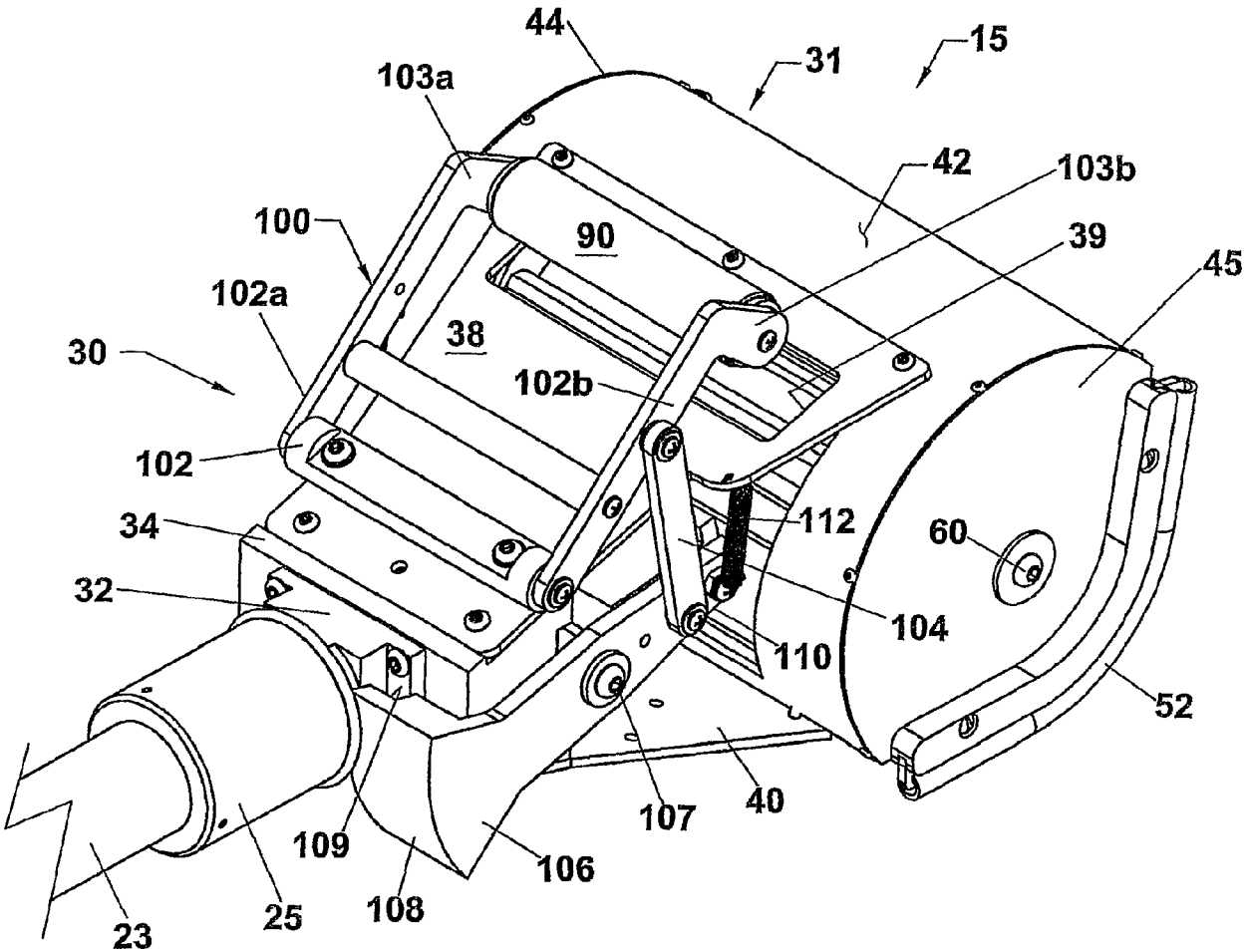
FIG. 4 is a perspective view looking toward the proximal side of the distal end portion of the portable scrubbing apparatus of FIG. 1.
Figure 5:
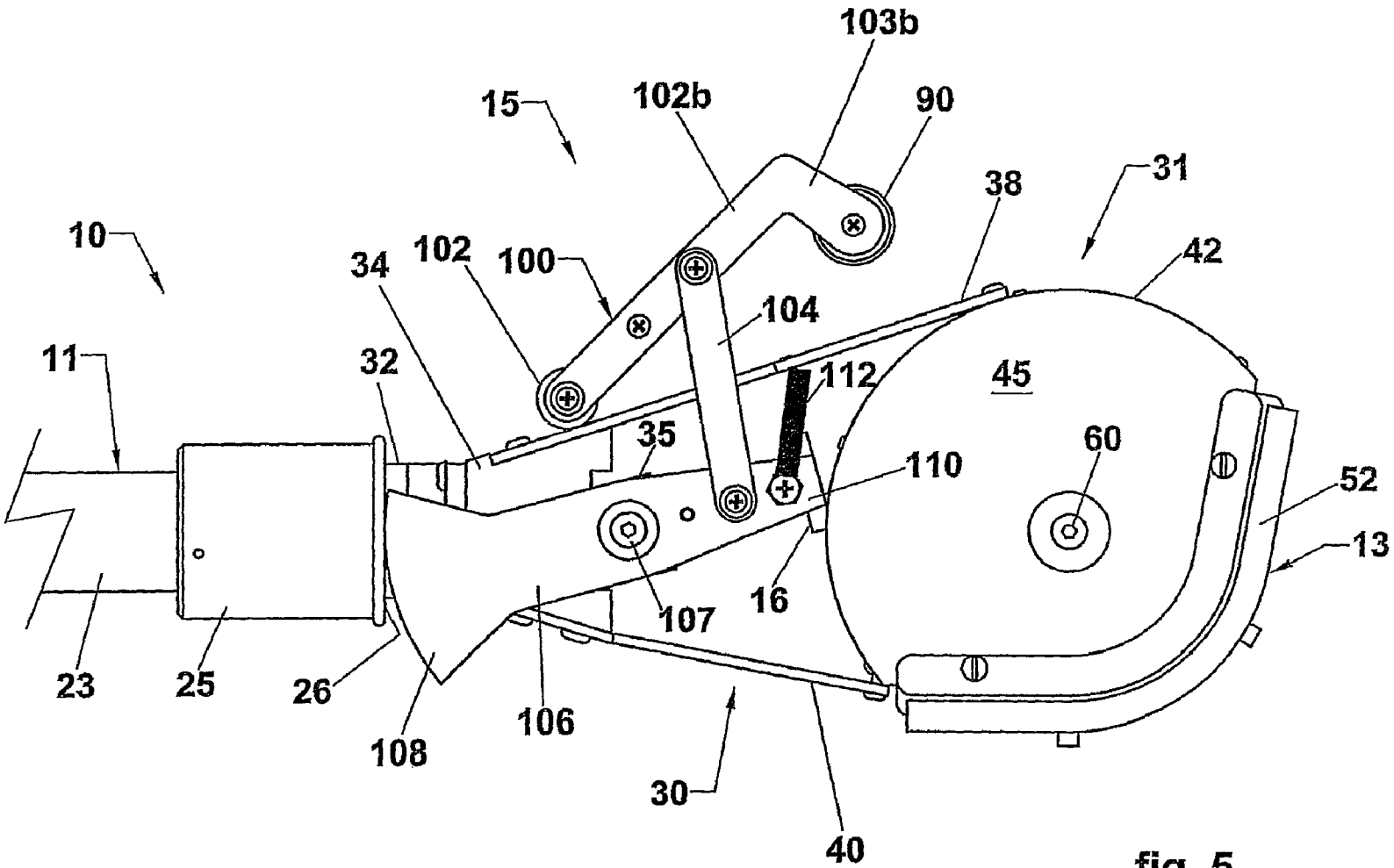
FIG. 5 is an elevational view of the distal portion of the portable scrubbing apparatus of FIG. 1 with a treatment material dispenser and dispensing system in a first position.

Referring now to FIGS. 1-3, a portable scrubber apparatus 10 includes a handle 11 having a hand grip 12 at one end and a scrubbing wheel 13 at the other end. A hose connector 14 at the proximal end provides for convenient attachment to a conventional garden hose or other fluid source (not shown) whereby water or other mobilizing or carrier fluid may be supplied under pressure from through valve 18 to the tube 17. Valve 18 can be selectively opened and closed by the user to permit, restrict or prevent water flow into a lumen 20 of tube 17. Any suitable valve is contemplated for valve 18. Water from lumen 20 is delivered to a nozzle 16 mounted adjacent a distal end opening of lumen 20 within a housing assembly 15

An actuator 23 extends about tube 17 from a proximal coupling 24 to a distal end member 25. Actuator 23 includes an elongated tubular arrangement that extends concentrically about and is spaced from tube 17. Proximal coupling 24 secures actuator 23 to tube 17 and maintains it in axial relation therewith. Actuator 23 and distal end member 25 are rotatable about tube 17 by the user grasping actuator 23 and rotating it about its longitudinal axis. The purpose and functioning of actuator 23 will be discussed further below. Handle 11 includes housing assembly 15 to rotatably mount scrubbing wheel 13 thereto. Housing assembly 15 includes a mounting portion 30 extending from tube 17 and a housing portion 31 for housing wheel 13. The mounting portion 30 can include a tube mount 32 positioned about and coupled to the distal end of tube 17. Any suitable coupling arrangement is contemplated, including threadingly engaging, fictionally engaging, welding, and/or adhering tube mount 32 to tube 17. Tube mount 32 can be coupled to the proximal end of a base member 34. Base member 34 can be axially secured on tube 17 with a retaining sleeve 36 that clamps base member 34 between tube mount 32 and retaining sleeve 36. Sleeve 36 can also be engaged about tube 17 using any suitable connection arrangement.

Base member 34 further includes nozzle mounts 35 in mounting portion 30 to which nozzle 16 is mounted. Base member 34 and retaining sleeve 36 each include a central passage that align with lumen 20 to provide a fluid path for delivery of fluid from lumen 20 to nozzle 16. Lumen 20 extends along a longitudinal axis 19 that intersects the rotational axis of wheel 13. Nozzle 16 defines a distally tapered lumen that extends along an axis 21. Axis 21 can be angled at an angle A relative to axis 19 to direct the fluid in a desired direction relative to scrubbing wheel 13 at a location offset radially from its rotational axis thereby effecting rotation of wheel 13 as the fluid impinges on radially extending scrubbing elements 74 passing by nozzle 16.

Mounting portion 30 of housing assembly 15 further includes an upper plate 38 having a distal end coupled to base member 34 and a proximal end coupled to a housing 42 of housing portion 31. Mounting portion 30 also includes a lower plate 40 having a distal end coupled to base member 34 and a proximal end coupled to housing 42 of housing portion 31. Nozzle 16 resides between plates 38, 40, which along with housing 42 can reduce or eliminate splashing or splattering of fluid on the user.

Housing 42 forms a partially cylindrical structure having opposite endwalls 44, 45 and a central space 46 defined thereby. Scrubbing wheel 13 is rotatably mounted to endwalls 44, 45 within space 46. Housing 42 further defines a proximal opening 48 adjacent nozzle 16 to receive fluid from nozzle 16 into space 46. Housing 42 also defines a distal opening 50 through which portions of scrubbing wheel 13 extend for positioning in contact with treatment surface 8.

The edges of housing 42 defining distal opening 50 can be lined with a protective member 52 to prevent damage to treatment surface 8 as housing 42 is moved therealong. Protective member 52 can be a rubber, elastomeric or other suitable non-rigid or non-abrasive material that flexes, slides, rotates or otherwise facilitates movement along treatment surface 8 when positioned thereagainst to prevent damage to the treatment surface. Protective member 52 can be provided with one or more elements that facilitate movement along the treatment surface, such as wheels, rollers, anti-friction coatings or lubricants, for example.

Scrubbing wheel 13 includes a central axle 60 rotatably mounted to endwalls 44, 45 of housing 42. A wheel hub 62 is positioned about and rotatable with axle 60. Wheel hub 62 includes a plurality of mounting elements 64 positioned circumferentially thereabout. Mounting elements 64 can each include a first retaining member 66 and a second retaining member 68 defining a receptacle 70 therebetween. Retaining members 66, 68 can each include concavely curved surfaces oriented toward one another defining receptacle 70. Scrubbing elements 74 are mountable in respective ones of the mounting elements 64 in a manner extending generally radially outwardly from the rotational axis of scrubbing wheel 13.

Scrubbing elements 74 each include an engaging member 76 that is positionable in receptacle 70 and a treatment portion 78 extending outwardly from engaging member 76. Engaging member 76 is rotatable in receptacle 70 so that treatment portions 78 can pivot in the direction opposite the rotational direction of wheel 13 when a second side of treatment portions 78 contact treatment surface 8, as indicated by arrow 80 in FIG. 3. Retaining member 66 permits some pivoting motion of scrubbing element 74 from its generally radially extending orientation to reduce forces that tend to counter the rotational force supplied by the fluid delivered from nozzle 16 to the first side of treatment portion 78. In the illustrated embodiment, engaging member 76 includes a rounded, rod-like profile that is rotatable within receptacle 70. Other coupling arrangements are also contemplated, including those where scrubbing elements 74 are recessed in hub 62, are attached with fasteners to hub 62, or other suitable coupling arrangements.

Second retaining member 68 includes a height H2 extending from wheel hub 62 that is greater than a height H1 of first retaining member 66. Second retaining member 68 thus extends along and contacts treatment portion 78 of the respective scrubbing element 74. As fluid from nozzle 16 is directed onto the first side of treatment portion 78, as indicated by arrow 82 in FIG. 3, second retaining element 68 resists pivoting of scrubbing element 74 in the direction in which wheel 13 is rotating (counterclockwise in FIG. 3) and maintains it in the generally radially extending direction. This results in force from the fluid being transmitted from scrubbing element 74 into rotary action of the wheel 13, preventing or reducing the potential for wheel 13 to slow or stop as the second side of treatment portions 78 contact treatment surface 8. In contrast, first retaining member 66 allows the scrubbing elements 74 coupled thereto to pivot from its radially extending orientation in the direction opposite the rotational direction of wheel 13. This allows scrubbing elements 74 to conform to the surface profile of the treatment surface 8 as wheel 13 is moved thereacross, and reduces resistance to rotation of wheel 13 when the treatment portions 78 contact treatment surface 8.

Scrubbing elements 74 can include treatment portions 78 in the form of wash cloth material, brush material, or rubber material, for example, that are mounted on the wheel. Scrubbing elements 74 include sufficient rigidity to transfer energy from the fluid delivered by nozzle 16 into rotary movement of wheel 13. Treatment portions 78 can be integrally formed with or removable from engaging member 76. It is further contemplated that the scrubbing elements 74 and/or treatment portions 78 can be removable or expendable units which may be clipped, pinned, snapped-onto, or otherwise mounted on wheel hub 62 or engaging members 76. In another form, the entire hub 62 is expendable or removable such that, when elements become worn, or a different type is needed, the entire hub including scrubbing elements is replaced.

Portable scrubbing apparatus 10 may further include a treatment material dispenser 90 and a dispensing system 100. Dispensing system 100 includes a bracket 102 having alms 102*a*, 102*b* pivotally mounted to upper plate 38 at one end of the arms 102, 102*b*. The opposite ends of the arms 102*a*, 102*b* include an L-shaped portion 103*a*, 103*b*, respectively. Treatment material dispenser 90 is rotatably mounted to and extends between the outer ends of the L-shaped portions 103*a*, 103*b*.

Dispensing system 100 further includes a link 104 having a first end pivotally coupled to aim 102*b* and a second end pivotally coupled to a cam 106. Cam 106 is also pivotally mounted to base member 34 about a pin 107. The distal end 110 of cam 106 is engaged to a biasing member 112. Biasing member 112 extends from distal end 110 to upper plate 38. Cam 106 further includes a cam surface 108 along an end thereof opposite distal end 110. Cam surface 108 is formed by an extension portion 109 that extends to a location adjacent to and in contact with distal end wall 26 of actuator 23. Cam surface 108 is curved along an arc so that contact with distal end wall 26 is maintained as cam is pivoted about pin 107.

Figure 6:
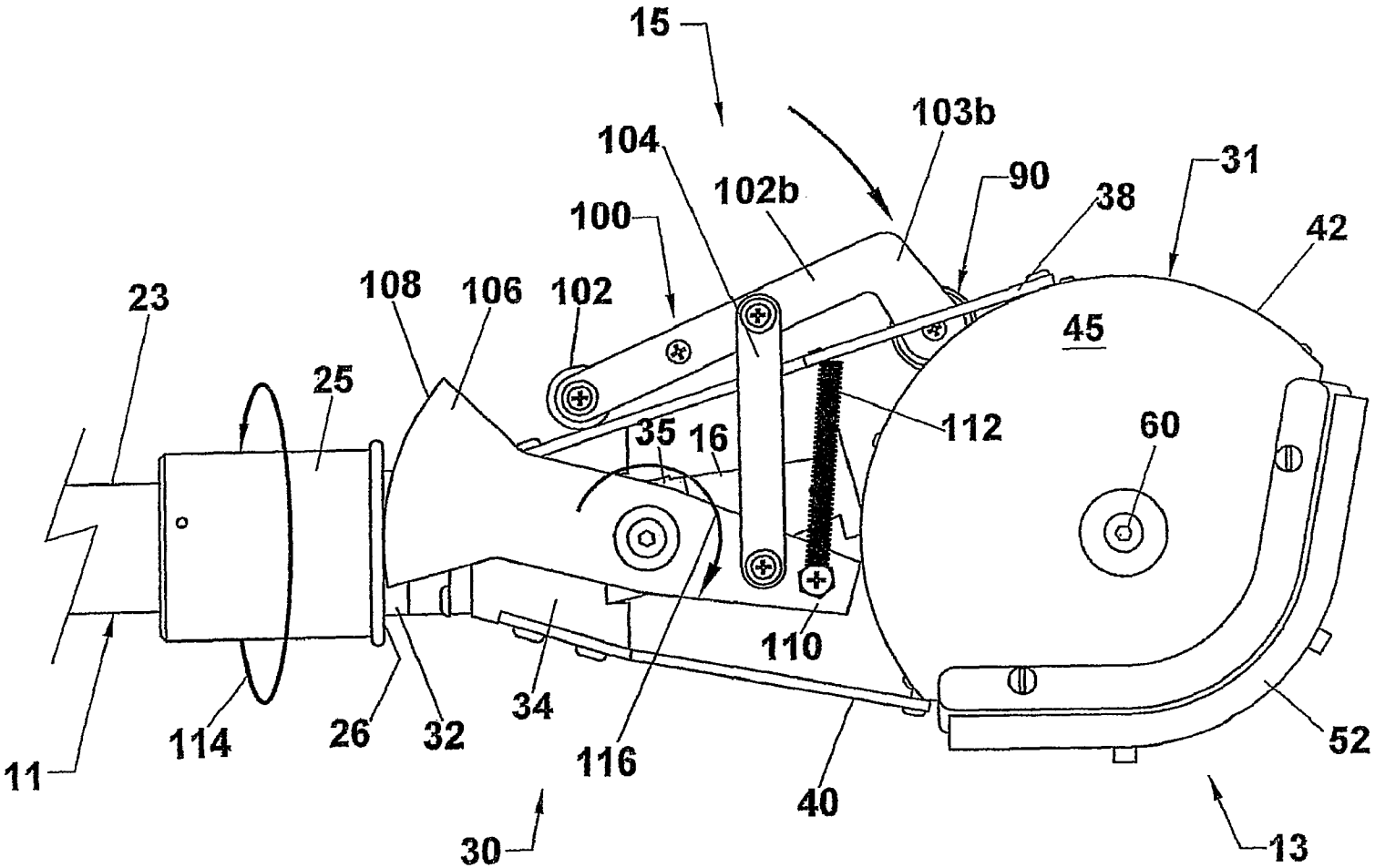
FIG. 6 is an elevational view of the distal portion of the portable scrubbing apparatus of FIG. 1 with a treatment material dispenser and dispensing system in a second position.

Dispensing system 100 includes a first position shown in FIGS. 1-5 where treatment material dispenser 90 is removed from space 46 and is movable with actuator 23 to a second position shown in FIG. 6 where treatment material dispenser 90 is disposed within space 46. Biasing member 112 normally biases treatment material dispenser 90 to the first position. In the illustrated embodiment, biasing member 112 is a spring that is normally compressed to pull distal end 110 of cam 106 toward upper plate 38. Rotation of actuator 23 in the direction of arrow 114 (FIG. 6) causes distal end wall 26 to rotate while in contact with cam surface 108. Cam surface 108 follows the rotational movement of end wall 26, which in turn causes cam 106 to rotate in the direction of arrow 116 (FIG. 6) moving distal end 110 downwardly against the bias of biasing member 112. As cam 106 is rotated, link 104 pulls aims 102*a*, 102*b* down toward upper plate 38 about their pivotal coupling with base 34 so that material dispenser 90 is received through window 39 of upper plate 38 and into space 46 of housing 42 in its second position. In the second position, the second sides of treatment portions 78 (opposite the side to which nozzle 16 is directed) of scrubbing elements 74 can contact material dispenser 90 so that treatment material is applied to the respective treatment portions 78 passing thereagainst. Treatment portions 78 can then apply the treatment material to the treatment surface 8 as they pass therealong.

When it is no longer desired to apply treatment material to treatment portions 78, actuator 23 can be released. Biasing member 112 pulls distal end 110 of cam 106 toward plate 38, pivoting cam 106 about pin 107 in the direction opposite arrow 116 back to its position shown in FIG. 5. Link 104 simultaneously pushes arms 102*a*, 102*b* of bracket assembly 102 upwardly away from upper plate 138, withdrawing material dispenser 90 through window 39 to its first position. Actuator 23 is also automatically rotated in the direction opposite arrow 114 by the force exerted by cam surface 108 of cam 106 on distal end wall 26 as cam 106 is pivoted by biasing member 112.

In the use of the portable scrubbing apparatus 10, it may first be connected to the garden hose or other suitable water supply with connector 14. Then the water supply is turned on with valve 18 opened or closed. The user may, if necessary, open valve 18 slightly or completely depending on the desired water flow to be discharged by nozzle 16 on the scrubbing elements 74. Housing 42 may be positioned along the treatment surface 8 so that treatment portions 78 of scrubbing elements 74 contact the treatment surface. If treatment material is desired to be applied, then actuator 23 can be rotated with one hand by the user while the other hand is engaged to hand grip 12. Rotation of actuator 23 moves dispensing system 100 and displaces material dispenser 90 into space 46 where it is contacted by the rotating scrubbing elements 74 passing thereby. When the desired treatment material has been delivered, actuator 23 is released and material dispenser 90 automatically returns to its first position out of space 46 by dispensing system 100.

Of course, the width of the wheel and particularly, the scrubbing elements 74 will depend upon the desired size of the apparatus, the water pressure and volume of water available. The overall length from grip 12 to wheel 13 can be such as desired for the particular application, and the convenience of the user. It is expected that the width of scrubbing elements 74 and/or housing 42 could be from two to twenty-four inches. The overall length of handle from end-to-end is expected to be between about six inches and six feet or more, again depending on the application. It could easily be up to six feet or more for floor or wall scrubbing. Handle 11 could also be adjustable in length to accommodate the size of the user and the nature of the task.

Material dispenser 90 can be constructed to include a roller 92 with opposite ends rotatably mounted to respective ends of L-shaped portions 103*a*, 103*b*. Treatment material 94 can be provided about the outside of the roller 92 in one or more layer of a solid form extending about all or a portion of roller 92. The treatment material can slowly wear away as it is delivered to the scrubbing elements 74 upon rotation of roller 92 about its longitudinal axis. Treatment material 94 can be provided in engagement with roller 92 so that it rotates therewith. In another embodiment, treatment material is provided about a sleeve that rotates relative to roller 92, and the ends of roller 92 are fixed relative to the ends of L-shaped portions 103*a*, 103*b*. Any suitable treatment material is contemplated, including soap, wax, and cleaning agents, for example. Material dispenser 90 can be readily removed from between arms 103*a*, 103*b* when the dispenser is empty or devoid of treatment material so that either a replacement dispenser can be positioned therebetween or the treatment material about roller 92 can be replaced.

In another embodiment, the material dispenser is in the form of a container in housing assembly 15 and in which soap or other treatment material is deposited. The container can include openings or passages that allow the scrubbing elements to contact the treatment material in the container for application to the scrubbing elements. The container can include a door or wall that is movable to block the openings or passages and prevent contact of the scrubbing elements and/or the fluid in housing assembly 15 with the treatment material. The container can also be moveable into and out of housing assembly 15, such as discussed above with respect to material dispenser 90, to allow selective application of the treatment material to the scrubbing elements. In a further variation, the treatment material can be dispensed from the container by changing from solid to liquid form upon contact with the water or other fluid in housing assembly 15. In still another variation, a material dispenser is provided that contains liquid treatment material. The liquid treatment material is selectively applied to the scrubbing elements by releasing, spraying or otherwise depositing the treatment material on the scrubbing elements.

Various materials of construction may be used. The housing may be made of metal or plastic for example, and portions of the housing which may inadvertently contact a fragile or decorative surface may be edged with a soft protective material such as soft plastic or soft rubber such as at protective member 52. Treatment surface 8 can be any surface for which scrubbing is desired. Examples include automobiles, boats, windows, gutters, and siding.

In other embodiments, scrubbing apparatus 10 could be supplied with liquid other than water and from other than a garden hose. It could be used for surface treatment other than scrubbing. Wet sanding or polishing are two possible examples. In still other embodiments, a dispensing system is not provided.

Figure 7:
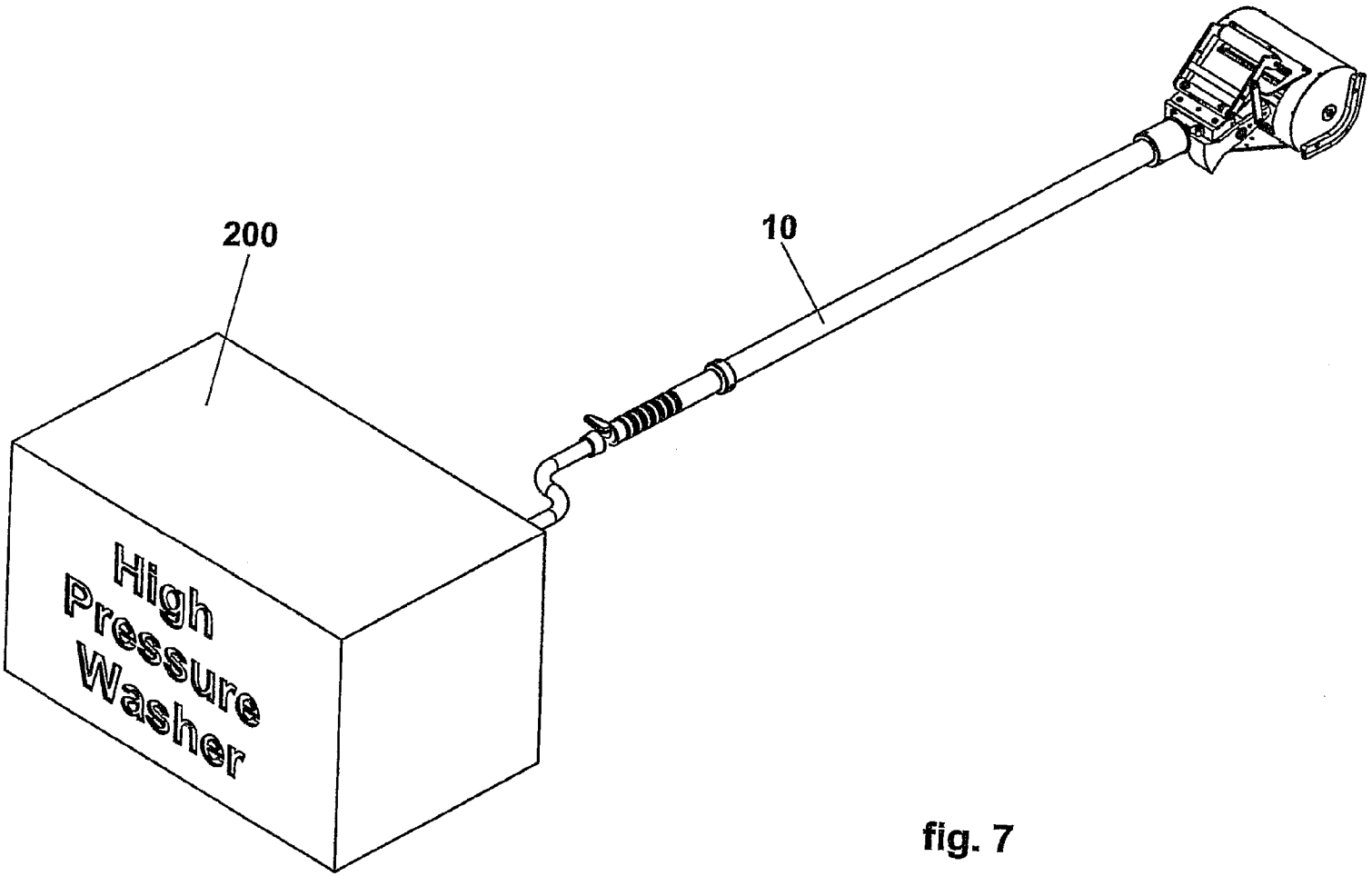
FIG. 7 is a block diagram showing attachment of a high pressure washer to the scrubbing apparatus.

In yet further embodiments, a high pressure washer device 200 can be provided and coupled to scrubber apparatus 10, such as shown schematically in FIG. 7. The hose connector 14 at the proximal end of the handle can be suitable configured for attachment to high pressure washer device 200 to allow the delivery of high pressure fluid such as water from device 200 to the lumen of scrubber apparatus 10 for delivery to housing assembly 15.

Washer device 200 can be portable by a cart, wheels or by hand carrying, or can be fixed in location. Washer device 200 can be electrically powered; powered by gasoline or other fuel, or include any other suitable powering system. Washer device can incorporate a heater to heat the fluid prior to delivery to scrubbing apparatus 10. In one form, washer device 200 is capable of delivering pressurized fluid ranging from 1000 to 6000 psi. Other forms contemplate pressurized fluid at less than 1000 psi or more than 6000 psi.

Referring now to FIGS. 8 through 17, the scrubbing apparatus 121 has a handle portion 122 and a housing portion 123. This can be made of two molded plastic shells secured together by rivets 124. Other approaches may be used if desired. Being portable, it can be carried easily by hand. There is a fitting 126 at the proximal end and which may be conveniently connected to a garden hose for supply of water, or to a high pressure washer device or to some other source of pressurized mobilizing or carrier fluid supply. Other external features include a nozzle operating cam control knob 127, a scrubber wheel axle clip 128, the end of a scrubber wheel axle 129, a housing cover 131 and the end of a cover hinge pin 132.

Figure 8:
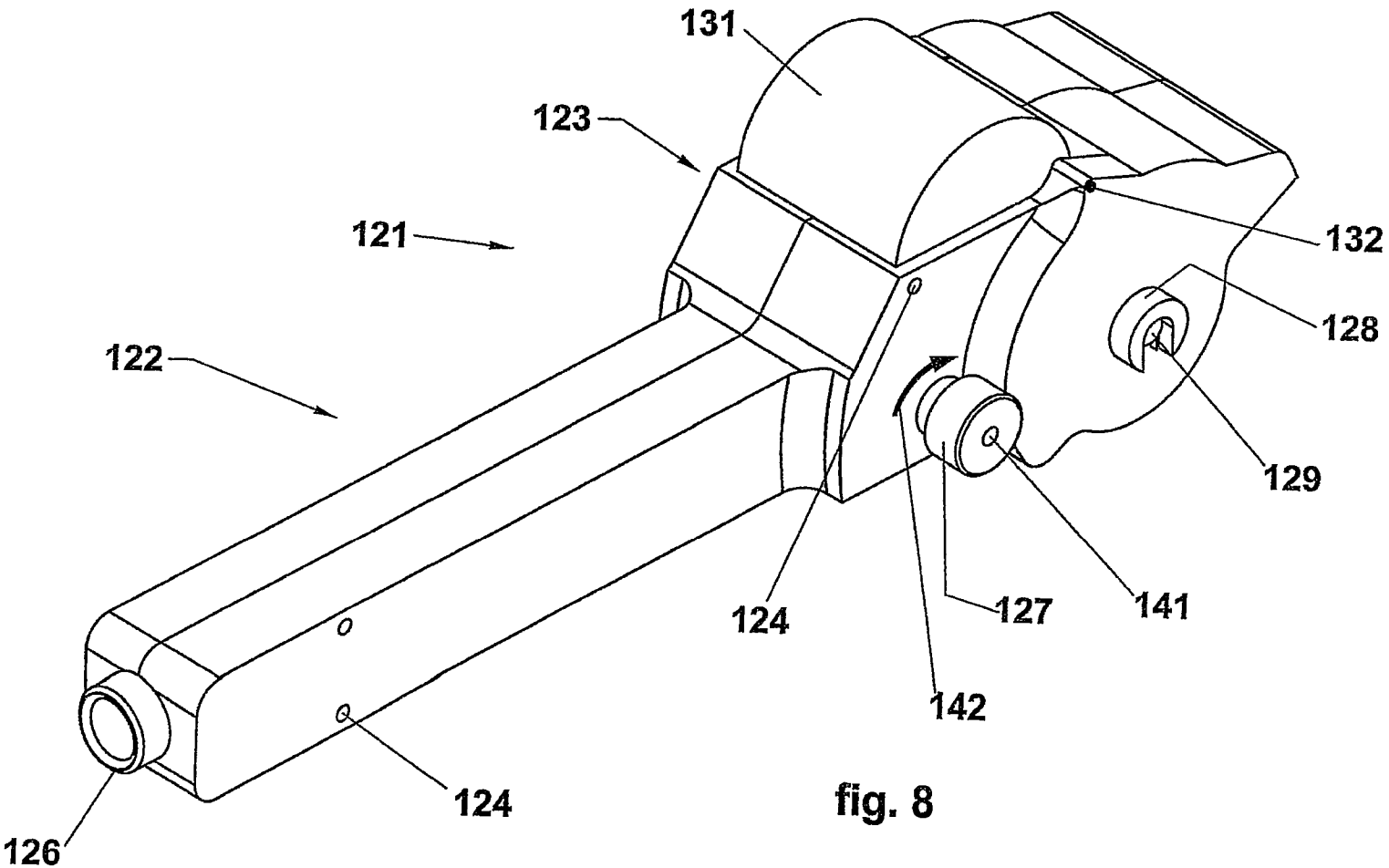
FIG. 8 is a perspective view of another embodiment of portable scrubbing apparatus looking toward its proximal end.
Figure 9:
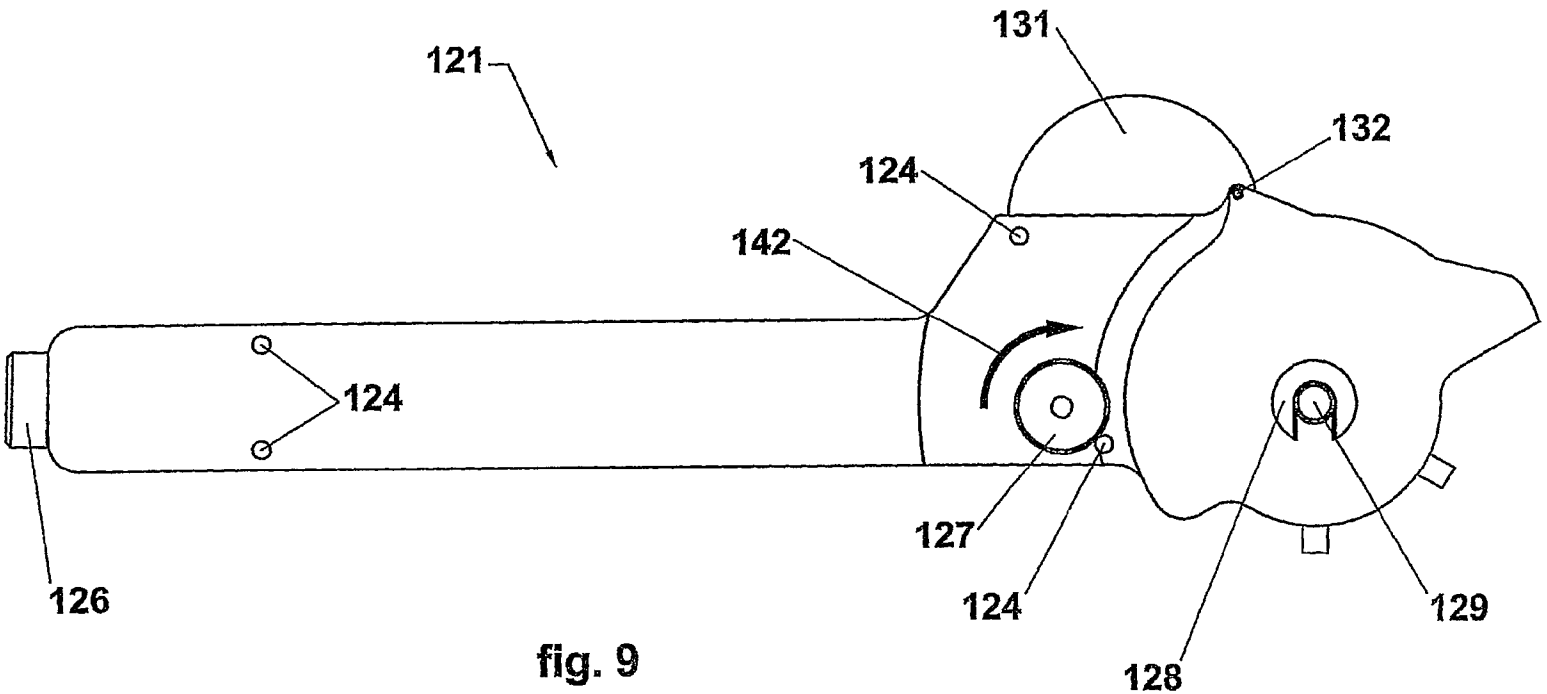
FIG. 9 is a side elevational view thereof.
Figure 11:
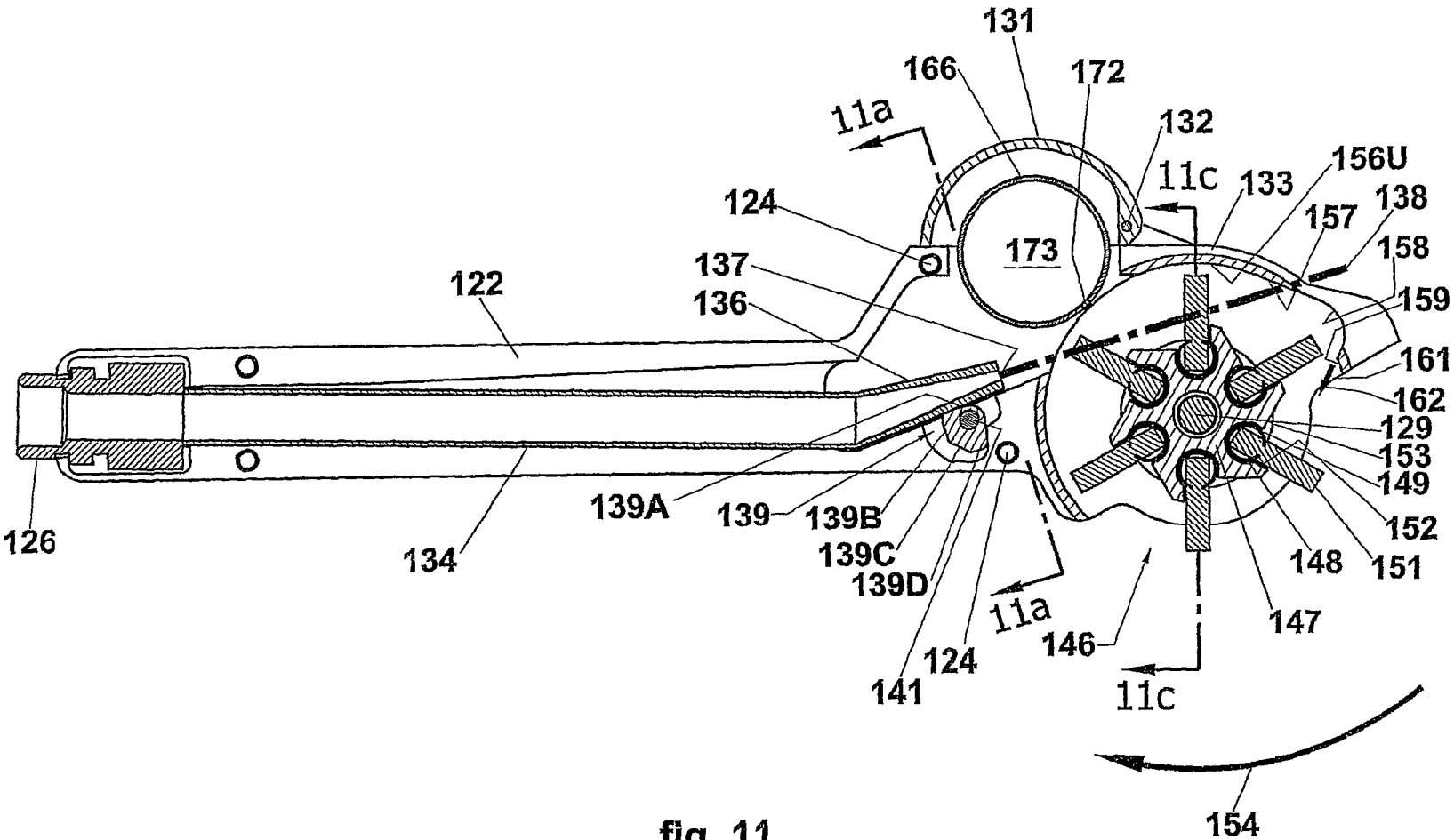
FIG. 11 is a cross-section through the FIG. 10 view at line 11-11 in FIG. 10 and viewed in the direction of the arrows.
Figure 12:
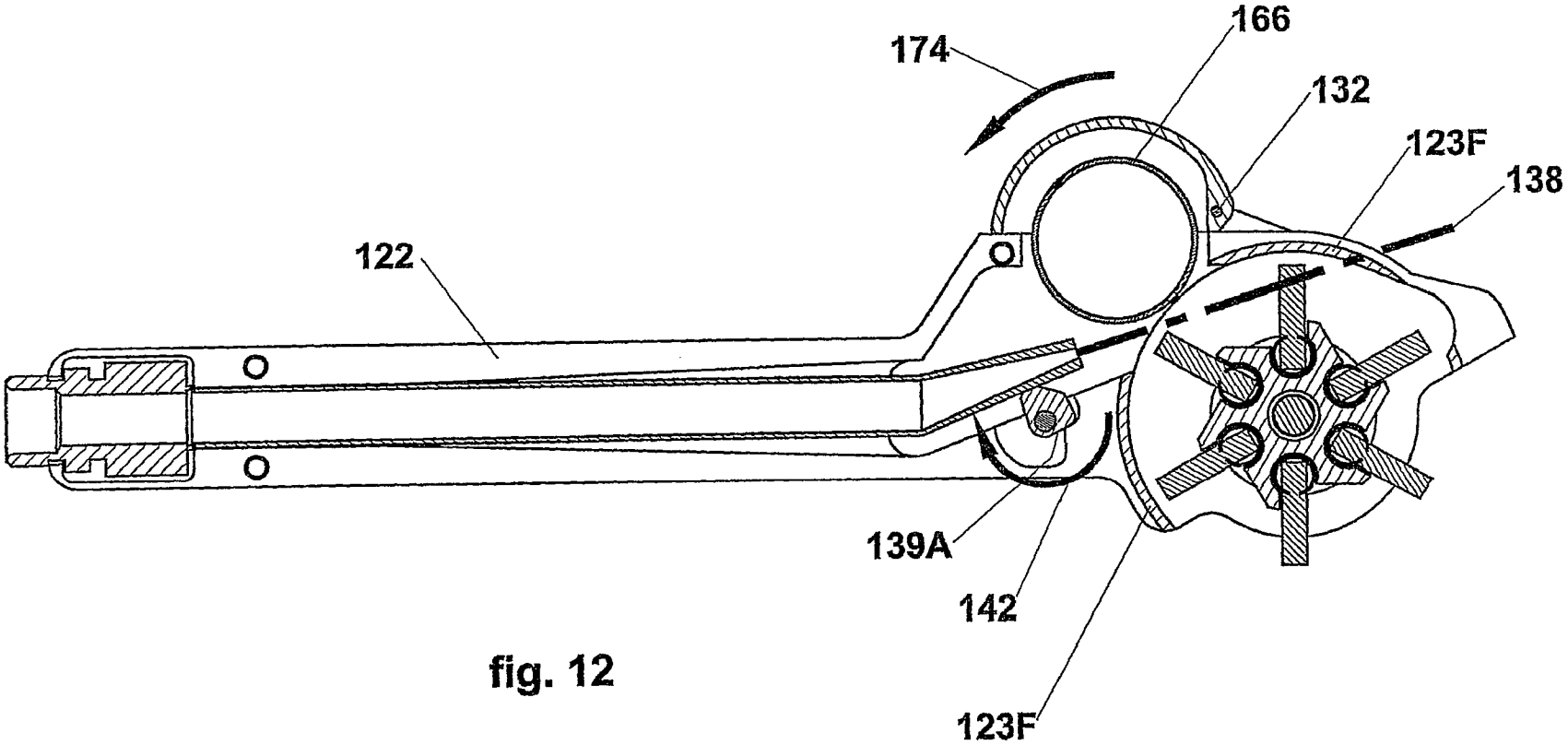
FIG. 12 is a view like FIG. 11 but with a different nozzle direction.

Referring now to FIGS. 11 and 12, and since the illustrated housing is a two-part shell-type construction, and the section plane 11-11 is at the junction of the parts, "cross hatching" of the housing in FIGS. 11 and 12 is minimal. But, there is a portion of the housing sectioned in FIGS. 11 and 12 at 123F and which represents an alignment flange to assist in assembly of the two-piece housing. Referring particularly to FIG. 11, tube 134 is provided to deliver liquid from the inlet fitting 126 to nozzle 136 which has a discharge outlet 137 with a discharge direction along imaginary line 138 for fluid from the nozzle. A cam 139 is mounted to a shaft 141 which extends through the wall of the housing and is connected there to knob 127, as shown in FIG. 8. This cam is operable by manually turning the knob 127 in the clockwise direction of arrow 142 to change the nozzle discharge direction 138 from that shown in FIG. 11 to that shown in FIG. 12. The fluid delivery tube 134 is fixed to the fitting 126 so that it does not pivot at the fitting, nor does the fitting pivot in the handle 122. Therefore, the tube 134 together with the nozzle, is bent by the operation of the cam from the position shown in FIG. 11, to that shown in FIG. 12. The bending is an elastic deformation so that, if the knob is turned counterclockwise (opposite the direction of the arrow 142), the nozzle can return back to the position shown in FIG. 11. For these two extreme positions of the nozzle, there are two flats 139A and 139D on the cam, as shown in FIGS. 11 and 12, respectively. There are two additional intermediate positions which can be established for the nozzle by engaging one or the other of the two additional flats 139B and 139C. These various positions of the cam are useful to establish different rotational speeds of the dispenser cartridge 166, as will be described.

Referring further to FIG. 11, the scrubbing wheel 146 is similar to that shown and described in the embodiment of FIGS. 1-6. The hub 147 is mounted on two bushings 147B received on axle 129 and rotatable relative to the axle 129. The hub has a plurality of circularly spaced receptacles 148 extending axially in the hub. Each of these receptacles is part cylindrical, as shown, and receives a retainer 149 fixed to the inboard portion of a scrubbing element 151. The retainer is a split tube FIG. 28, which receives the element endwise in the split and as thus assembled and fixed together, slides endwise into the receptacle. When the hub spins with no load on it, the scrubbing elements will extend radially outward relative to the hub and axis of the shaft 129. Each of the receptacles 148 has an outer stop 152 and an inner stop 153. Since the retainer is generally cylindrical, it is able to pivot within the receptacle 148 to permit the scrubbing element to swing between the stops 152 and 153. Therefore, as described above with reference to FIGS. 1-6, a discharge from the nozzle 136 in this embodiment, shown in FIG. 11 with the wheel installed as shown, will cause the wheel to rotate in the clockwise direction as indicated by arrow 154 (FIG. 11). Also, to the extent the scrubbing elements on the rotating wheel may be applied to a surface to be scrubbed, each scrubbing element 151 may pivot backward against one of the stops 153, but again deploy, due to centrifugal force as soon as the element rotates away from engagement with the scrubbed surface. Then, the element is again in an erect attitude against the stop 152. Therefore, when engaged by the fluid discharge blast from nozzle 136, the element is driven forward to continue the rotation of the wheel.

To start and increase speed of rotation of the dispenser cartridge 166, the cam can be turned in the clockwise direction away from engagement of the flat 139A with the nozzle, and stopped at engagement with the nozzle of any one of the other three flats 139B, 139C and 139D, for an increase of speed at each of these flats in succession.

Referring further to FIG. 11, the upper interior wall 156U of the housing portion is generally cylindrical directly above the wheel 146. But it blends into a relatively flat surface 157 tangent to the cylinder at the portion which extends forward and downward to a reverse curve 158, which ends at 159 immediately above the scrubber front opening 161. This curved surface 158 redirects the fluid moving around the inside of the housing along with the scrubbing elements and down in the direction of the surface at the edge 159 where the fluid is directed toward the descending scrubbing elements at that location as shown in FIG. 11 by the arrow 162. Therefore, remaining energy in the fluid continues to be used in turning the wheel, thus, increasing the power applied while reducing lost energy which could otherwise occur by unnecessary water spraying out of the front of the wheel housing onto the surface being scrubbed.

Figure 10:
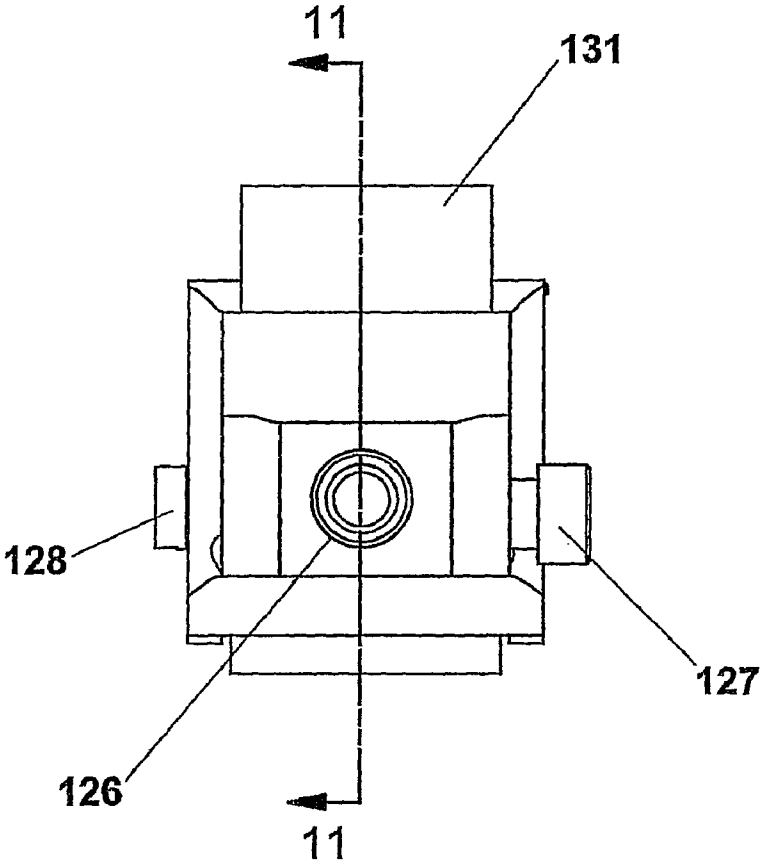
FIG. 10 is an end view thereof looking at the proximal end.
Figure 11A:
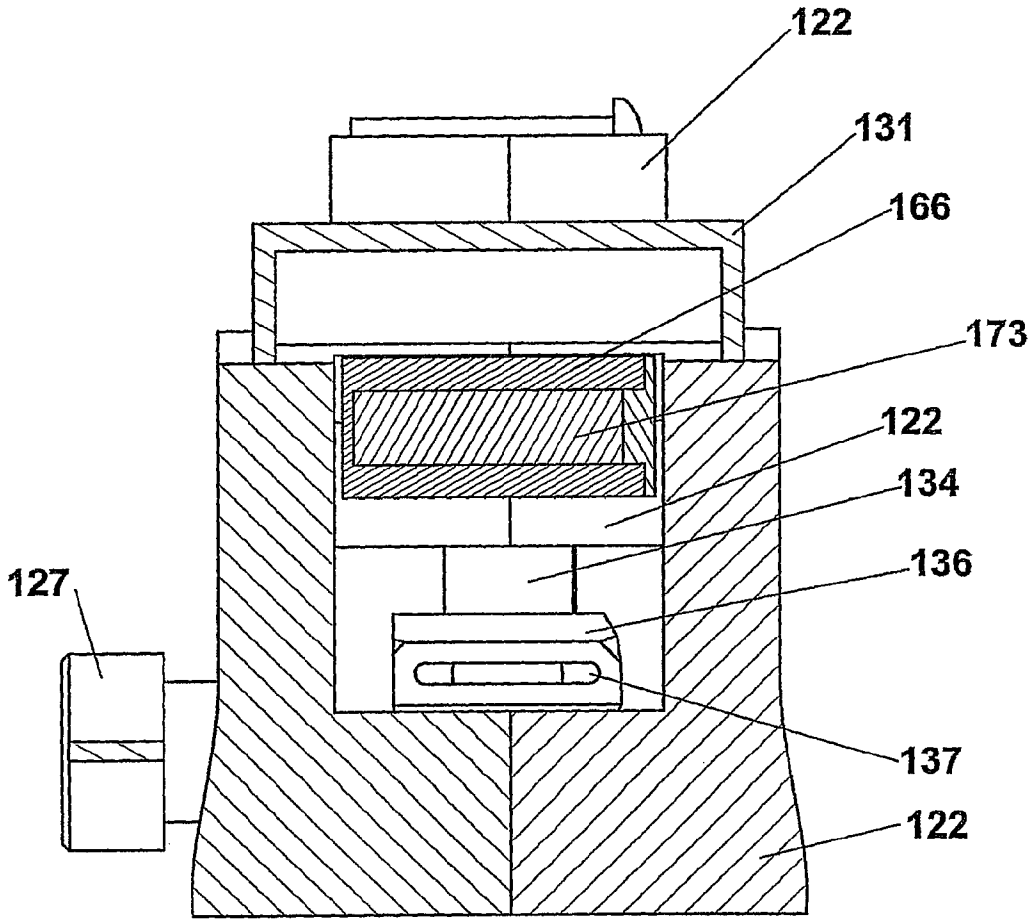
FIG. 11*a* is a cross-section taken at line 11*a*-11*a* in FIG. 11 and viewed in the direction of the arrows.
Figures 11B, 28:
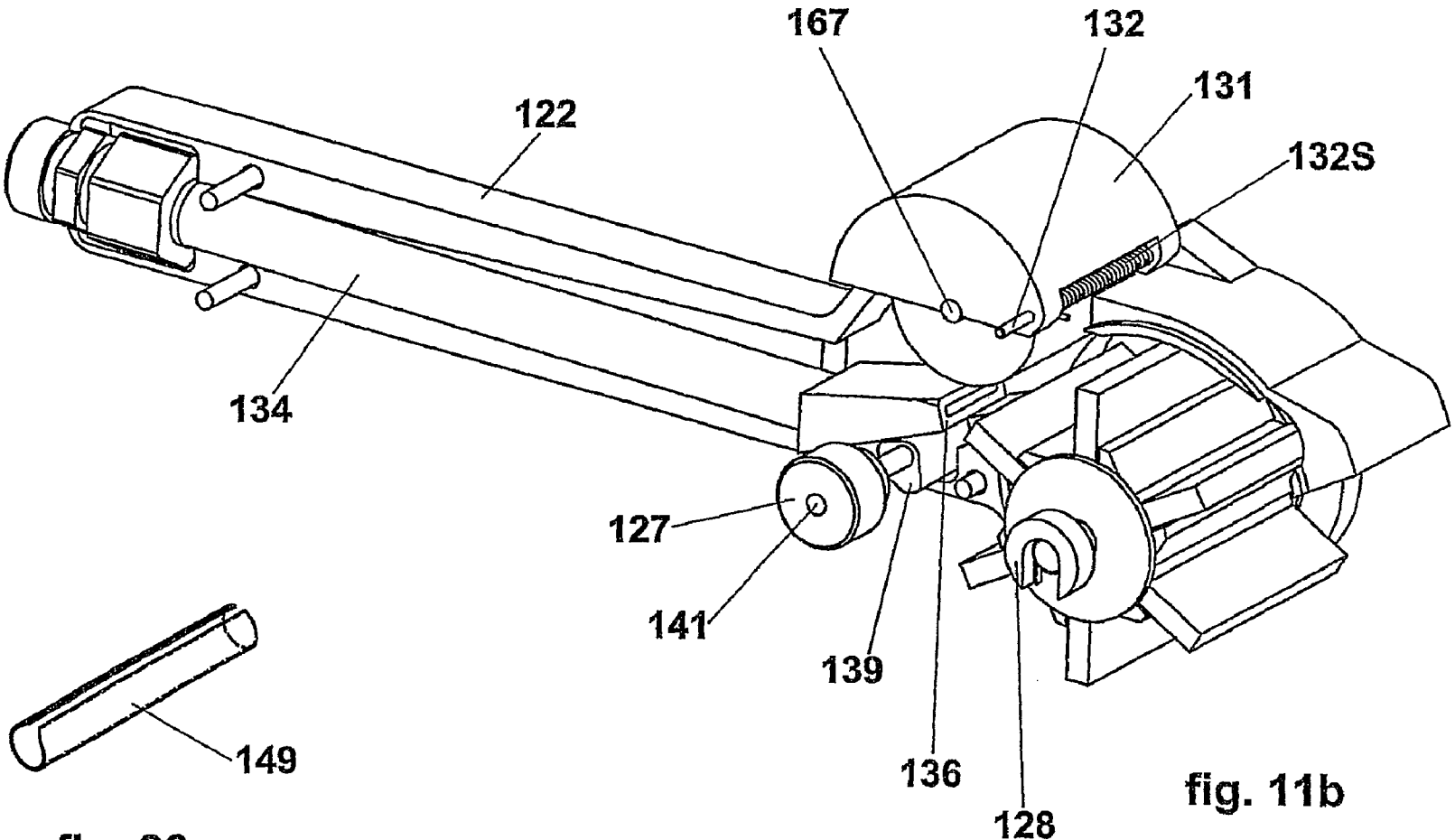
FIG. 11*b* is a perspective cut-away view thereof, looking toward the distal end.
FIG. 28 is a perspective view of a treatment element retainer tube.
Figure 11C:
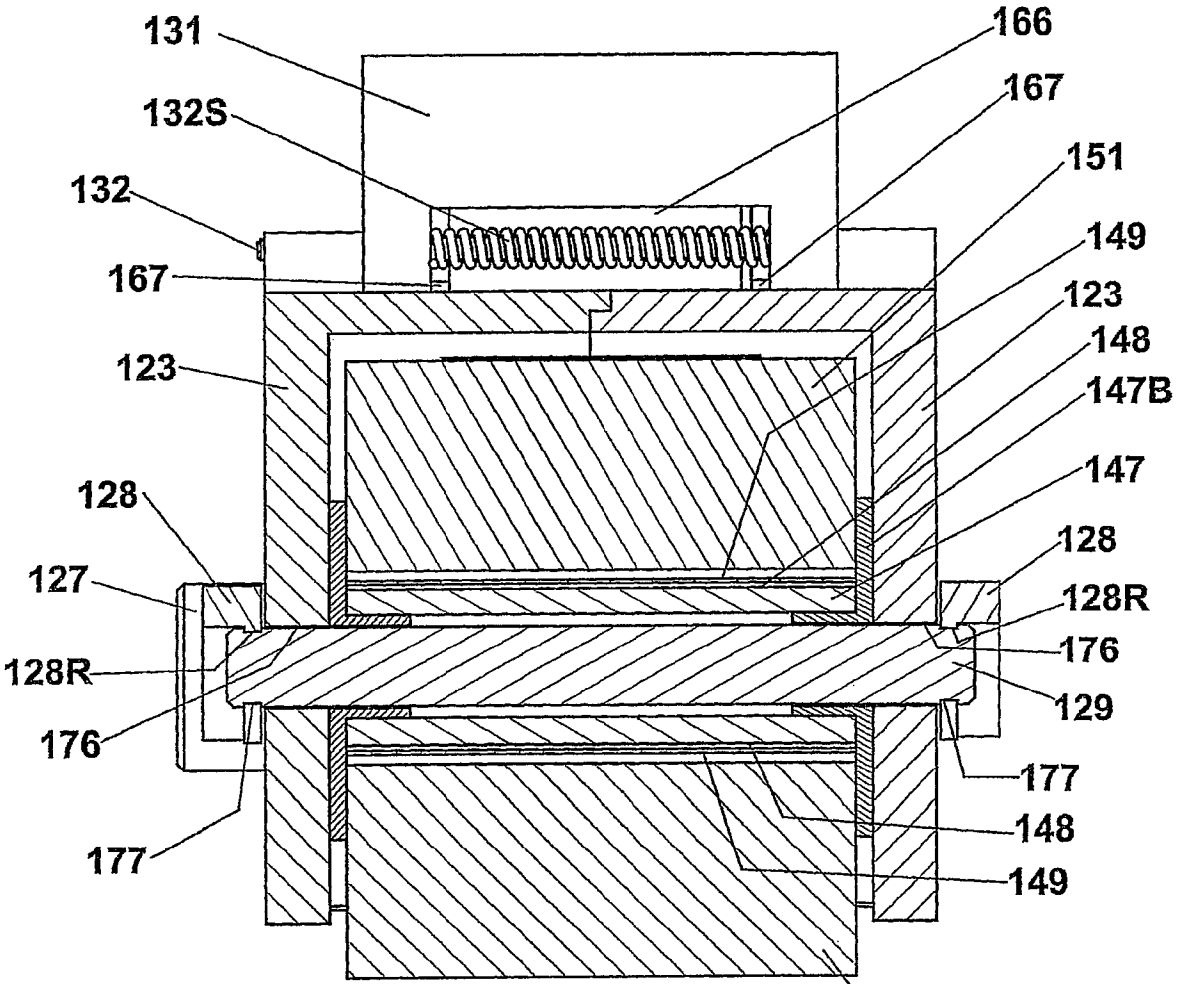
FIG. 11*c* is a cross-section taken at line 11*c*-11*c* in FIG. 11 and viewed in the direction of the arrows.
Figure 13:
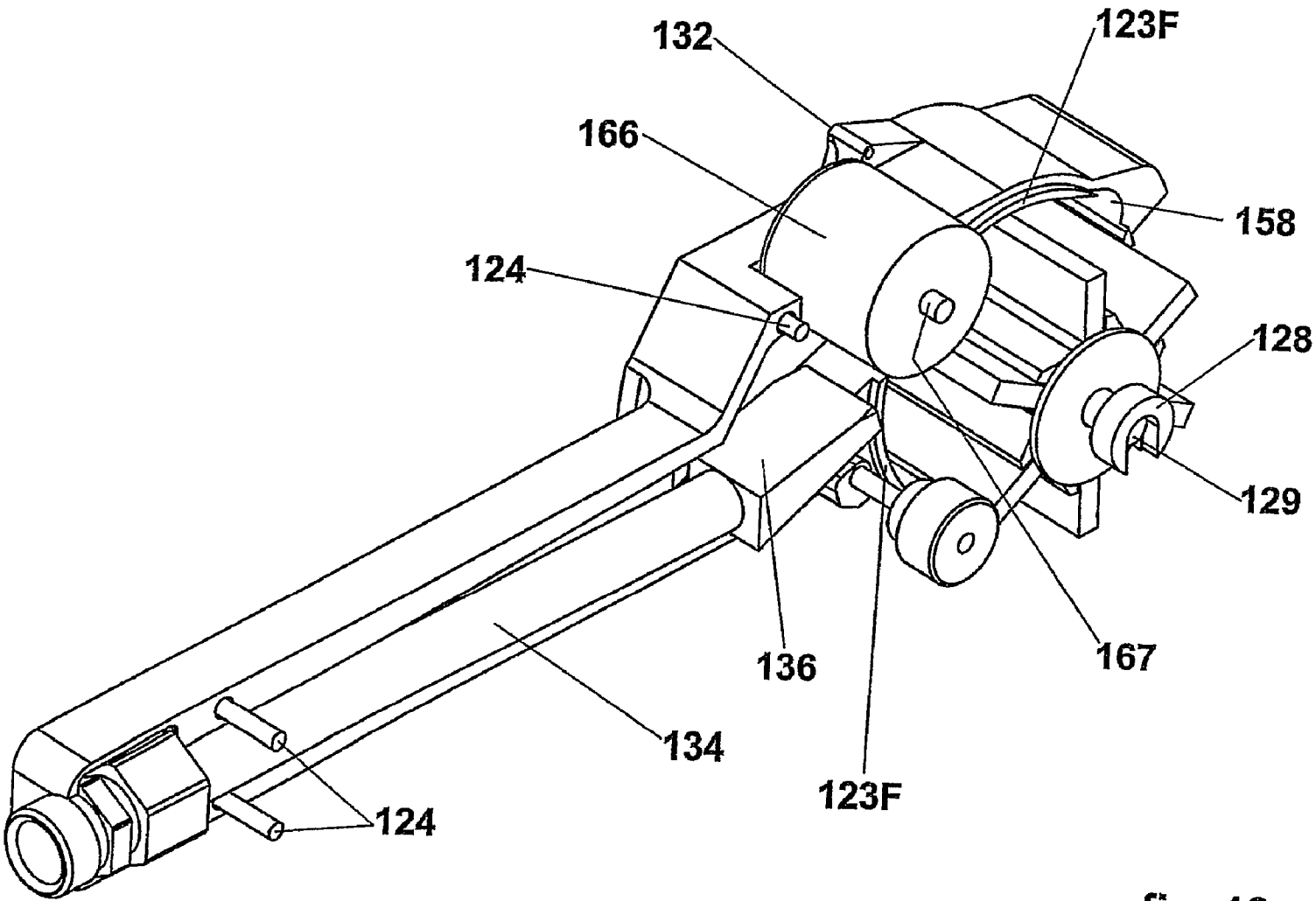
FIG. 13 is a cut-away view thereof looking toward the proximal end.
Figure 14:
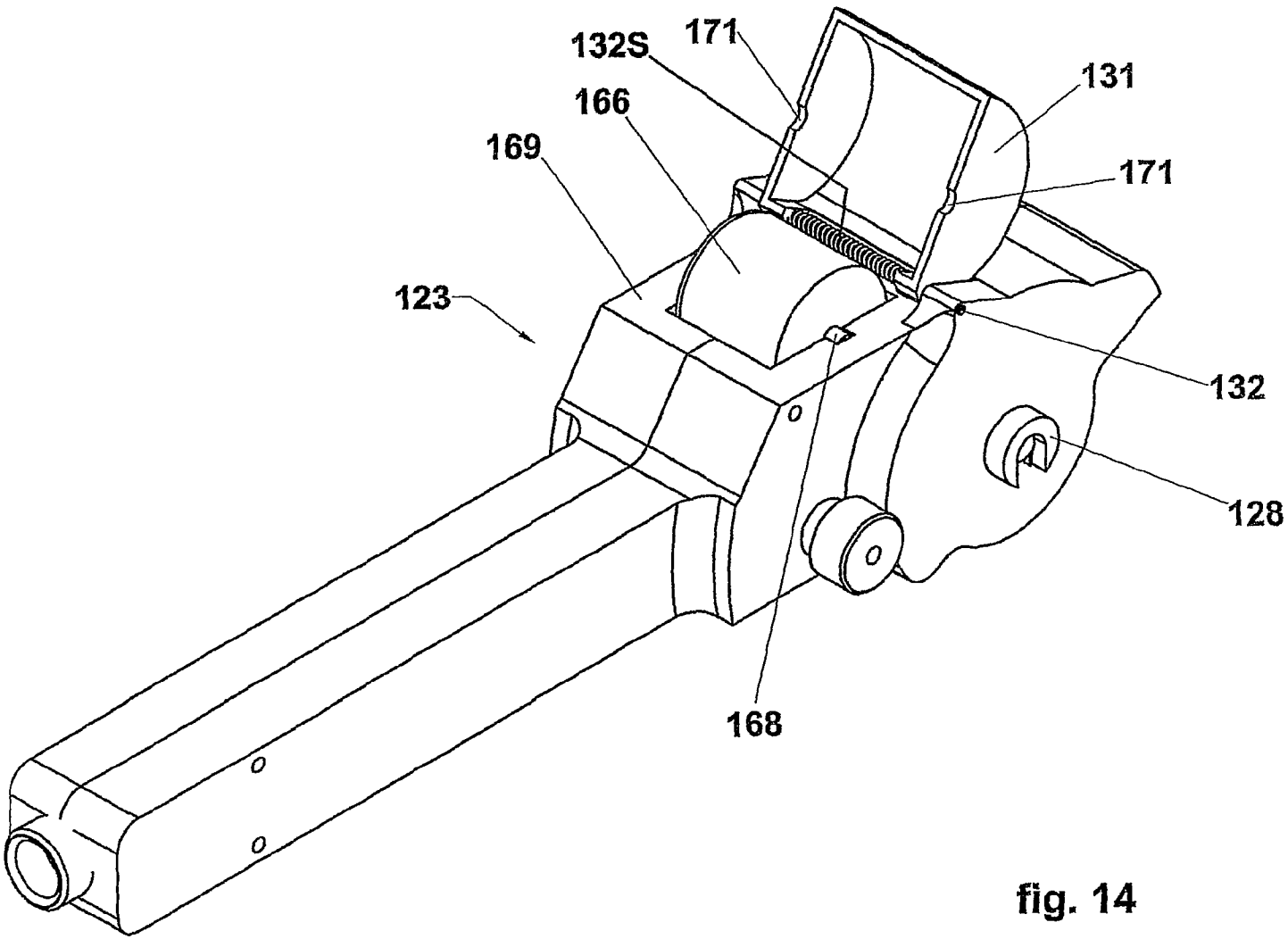
FIG. 14 is a perspective view thereof showing the liquid dispenser cartridge cover opened.
Figure 15:
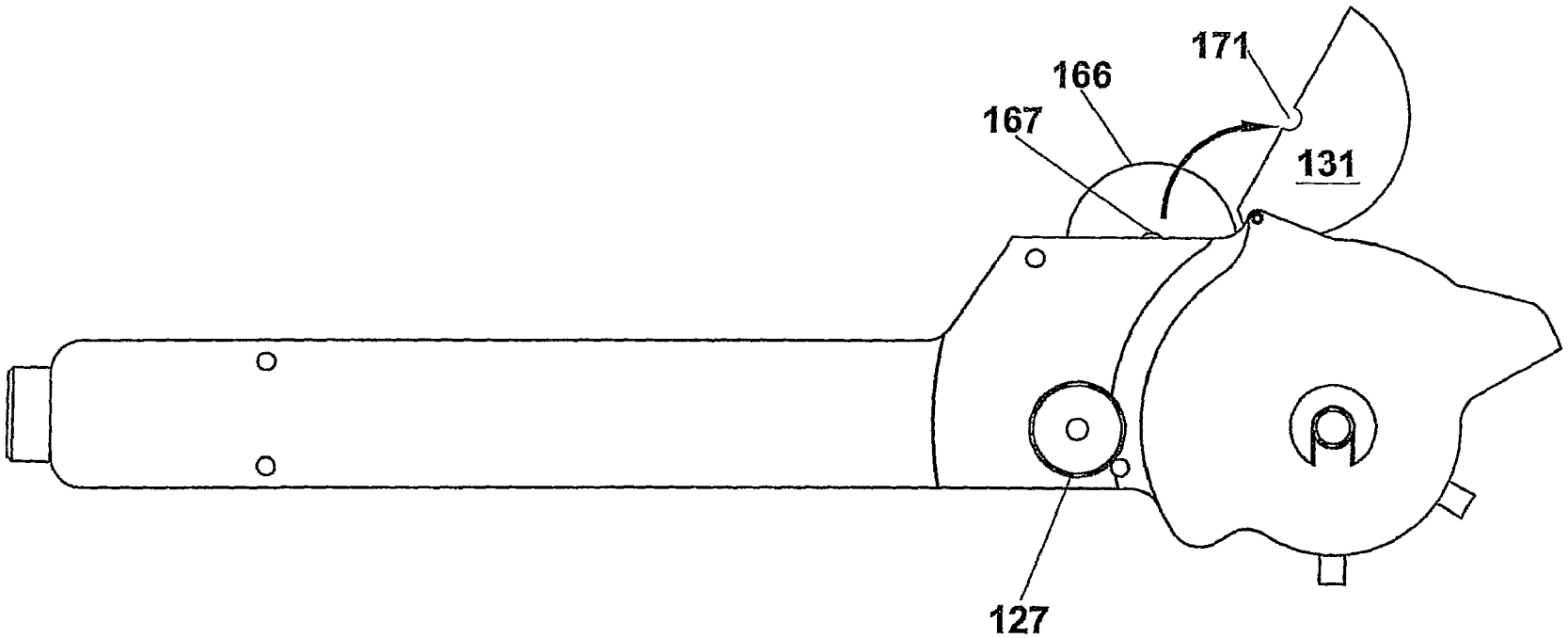
FIG. 15 is a side elevational view thereof showing a housing portion schematically
Figure 16:
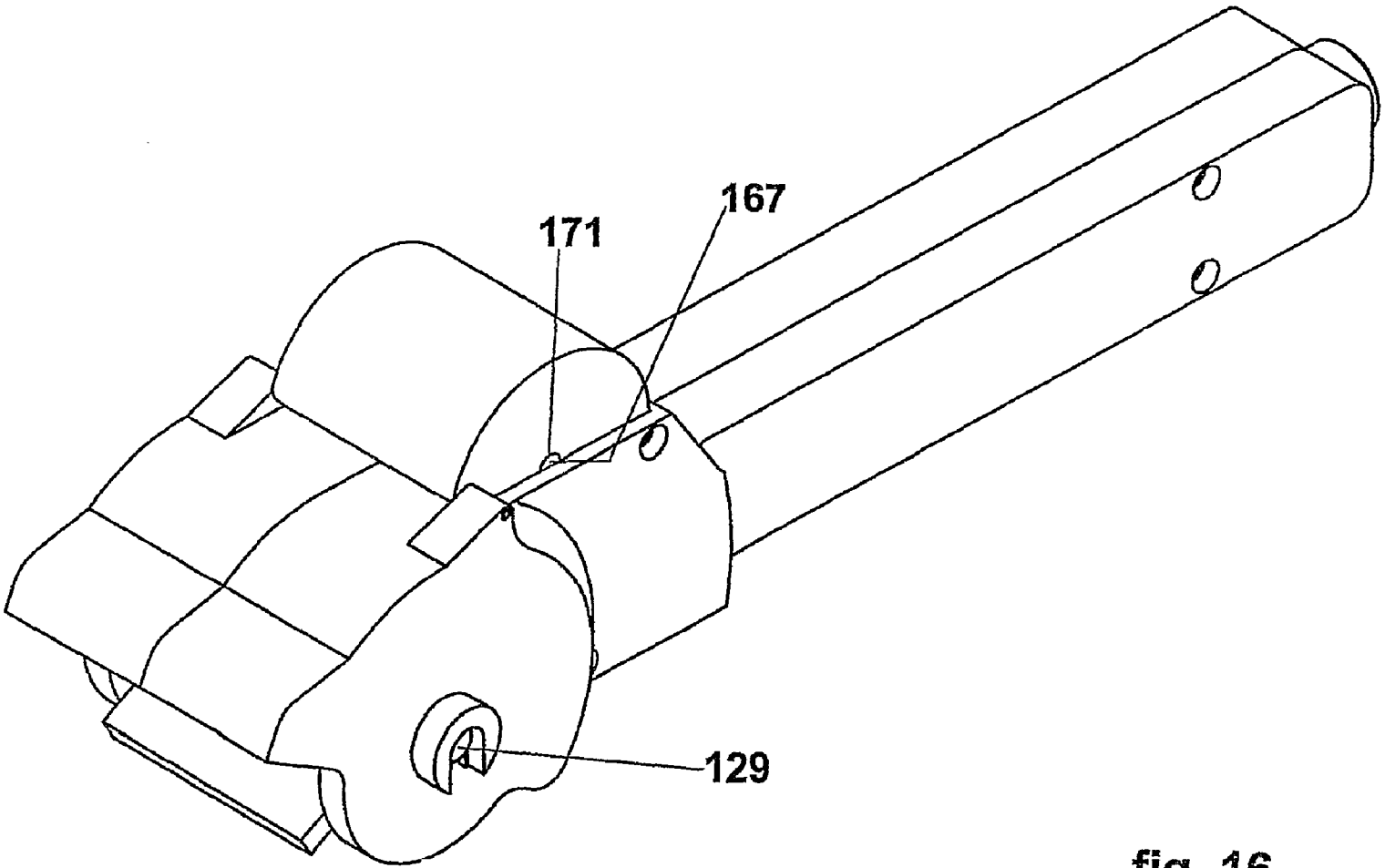
FIG. 16 is a perspective view thereof with the cover closed and looking toward the distal end of the portable scrubbing apparatus of FIGS. 8 through 15.
Figure 17:
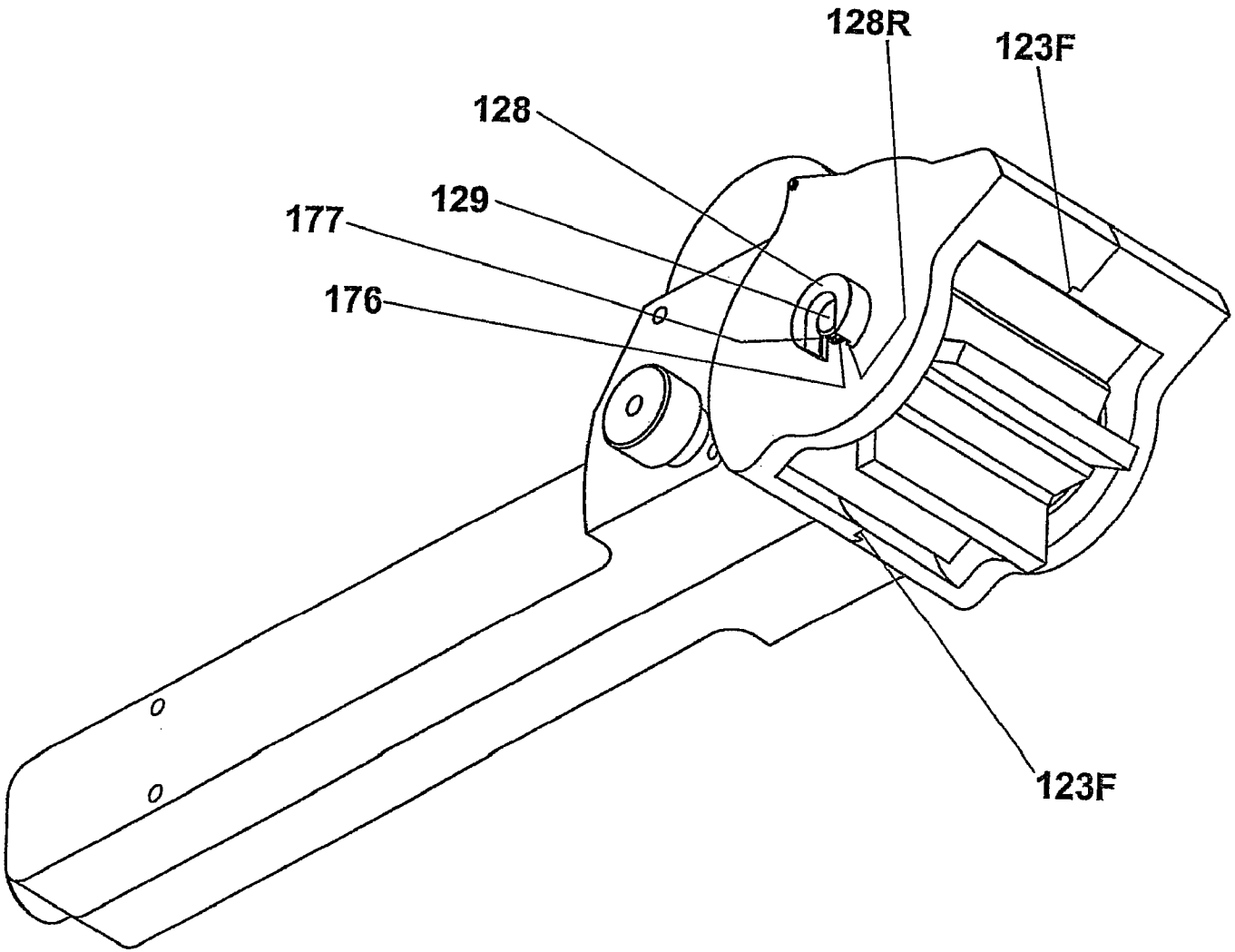
FIG. 17 is a perspective view of the embodiment of FIGS. 8 through 16 looking upward toward the distal end.

Referring now to FIGS. 11*c* and 13 along with FIG. 10, a treatment material dispenser is shown in the form of a replaceable cylindrical cartridge 166 which has axle stub pins 167 which extend out both ends and are received in upwardly opening circular notches 168 (FIG. 14) in the top surface 169 of the housing portion 123. The cover 131 is normally closed over the cartridge and has downwardly opening circular notches 171 providing upper bearings for the axle pins 167 so that, when the lid is closed, the lower and upper notches 168 and 171, respectively, provide end bearings for support and rotation of the cartridge 166. As previously mentioned, the cover is pivotable on hinge 132 and is spring-loaded so that it normally is held in the closed position by a coil spring 132S wound around the axle 132 as shown in FIGS. 11*c* and 14.

As shown in FIG. 11 and the other sectional views, the cartridge has a small opening 172 in the wall thereof providing an opportunity for a liquid treatment material 173 in the cartridge to escape if there is sufficient centrifugal force due to spinning of the cartridge. As an example, the opening may be a port about 0.015 inches in diameter. Some other shape or size, or multiple openings, might be used. When the nozzle is placed in the highest angle of discharge, as shown in FIG. 12, there is enough spray touching the surface of the cartridge to make it spin rapidly in the counterclockwise direction of arrow 174. As it does so, it dispenses the liquid from the cartridge into the scrubber wheel portion of the housing for mixing with the fluid applied to the scrubbing elements and to the surface of whatever is being scrubbed. In contrast, with the cam turned so that the nozzle is resting on the low face 139A of the cam, in the position of the nozzle shown in FIG. 11, there is virtually no portion of the spray discharge from the nozzle against the cartridge, so the cartridge can stop rotating and thereby stop dispensing liquid treatment material. With the cam in the position shown in FIG. 12, the high face 139D of the cam is supporting the nozzle, and there is maximum dispensing of the liquid treatment material. Cam faces 139B and 139C may be used to provide speeds intermediate the cartridge at rest and the maximum cartridge speed.

As shown in FIG. 13, although the tube 134 is shown cylindrical, it can be or have any cross-sectional shape or have a transition portion of any cross-sectional shape to the nozzle inlet. The nozzle portion may be more rectangular so that the outlet 137 may be a generally rectangular slot, if desired. While the nozzle may be the full width of the interior of the housing or the wheel, it is not necessarily the full width as is shown in FIG. 11*a*.

Referring again to FIG. 11*c*, to facilitate replacement of the scrubbing wheel, the axle 129 extends entirely through the housing portion 123 and the hub 147. The hub is rotatable relative to the axle so that the axle can, if desired, remain stationary in the axle receiving holes 176 in both sides of the housing portion. The axle has a circular groove 177 in each end portion (FIGS. 11*c* and 17) and is retained in the housing by a rib 128R of the retaining clip 128 at each side of the housing. Therefore, if it is desired to replace the wheel, the clips on one or both sides are removed, the axle is pulled out and the wheel can be simply dropped out of the opening in the bottom of the housing. A new wheel can be installed by simply reversing the procedure. If desired, one end of the axle can have a head or integral flange on it, and the groove and clip only on the other end. In that case, the clipped end on one side is unclipped, and the axle is pulled out the other side to release the wheel.

The treatment material in the cartridge may be a soap, detergent, polish, wax, or other material appropriate for the intended effects of the tool.

Figure 18:
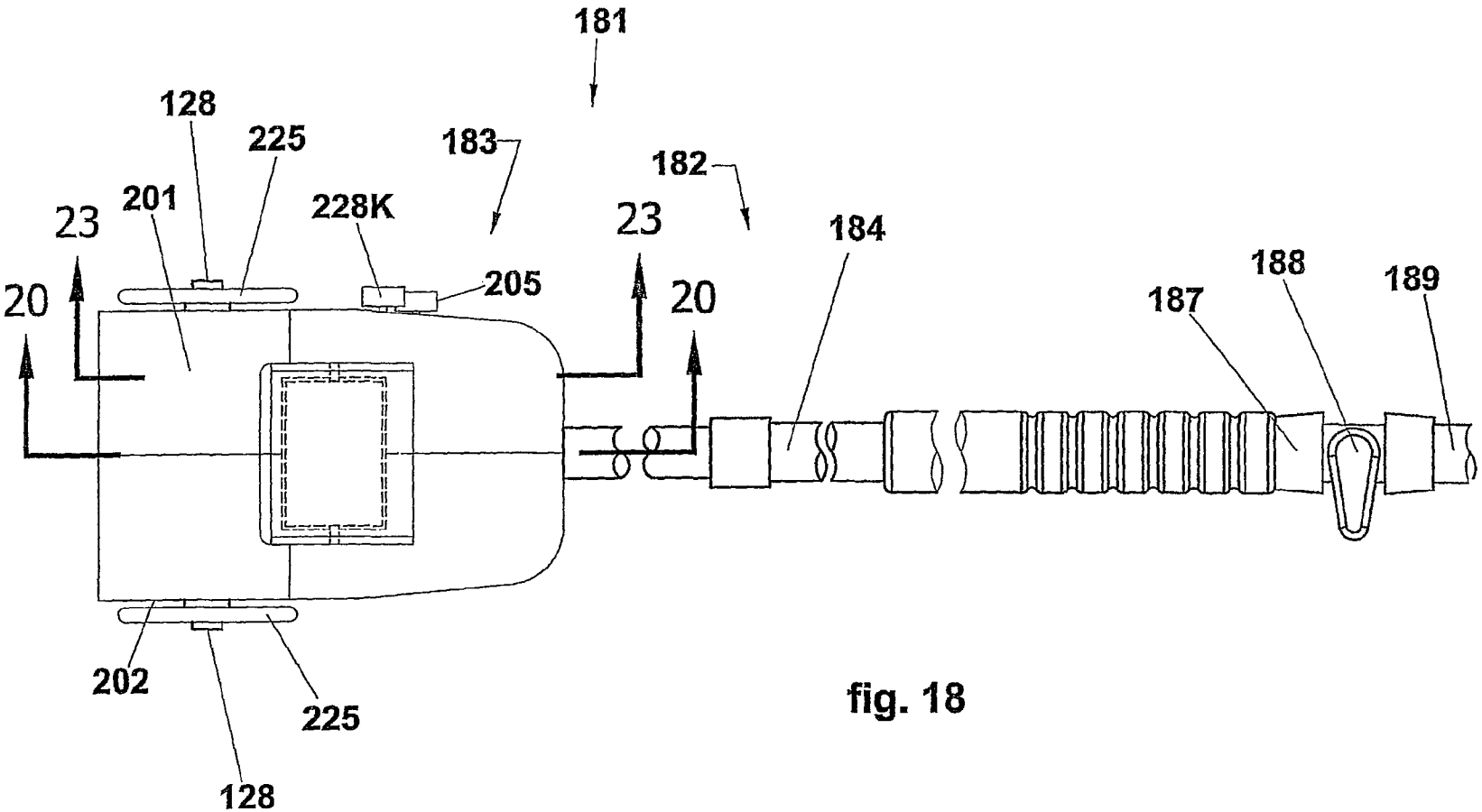
FIG. 18 is a top plan view on a smaller scale of another embodiment with some different water discharge features.

Referring now to FIG. 18 and following, another embodiment of the invention is disclosed. In this embodiment of invention, the scrubber assembly 181 includes a handle portion 182 and housing portion 183. The handle portion is a generally conventional tube 184 having threads at one end received into the threaded socket 186 in the housing portion and having a fitting 187 at the proximal end capable of receiving a conventional garden hose valve assembly 188 connected to a garden hose 189. Accordingly, this scrubber is readily adapted to use with the conventional garden hose for propelling a scrubber wheel and a treatment material cartridge. It should be understood that other sources of supply of pressurized liquid for mobilizing a scrubber wheel and/or carrying a liquid treatment material may be used. The scrubber wheel 191 is very similar to that shown in the embodiments disclosed in FIGS. 1-6. Thus, it has a hub 192 mounted for rotation on axle 193. It has a plurality of circularly spaced receptacles 194 receiving scrubbing elements 196 including retainers 197 and treatment elements 198. As in the previously described embodiments, the scrubber wheel can be removed from the housing by removing a clip 128 from one end of the axle and pulling the axle through the holes in the left and right hand sides of the housing. Then the scrubber wheel can be simply pulled or dropped out of the front opening in the housing. A new scrubber wheel can be installed in the reverse manner by simply placing it in the opening and pushing the axle back through the holes in the housing and applying the spring clip to the slotted end of the axle.

The scrubber wheel, when outside the housing, can have the treatment elements replaced by simply pulling them axially out of the receptacle slots and replacing them with new ones. When the wheel is installed back again in the housing, the inside faces of the housing side walls 201 and 202 or bushings such as 147*b* (FIG. 11*c*) will prevent the treatment elements from moving axially in the receptacle slots 197. Other means for doing so could be employed readily if desired. Of course, they are able to pivot as described above with reference to the previously described embodiments.

Figure 20:
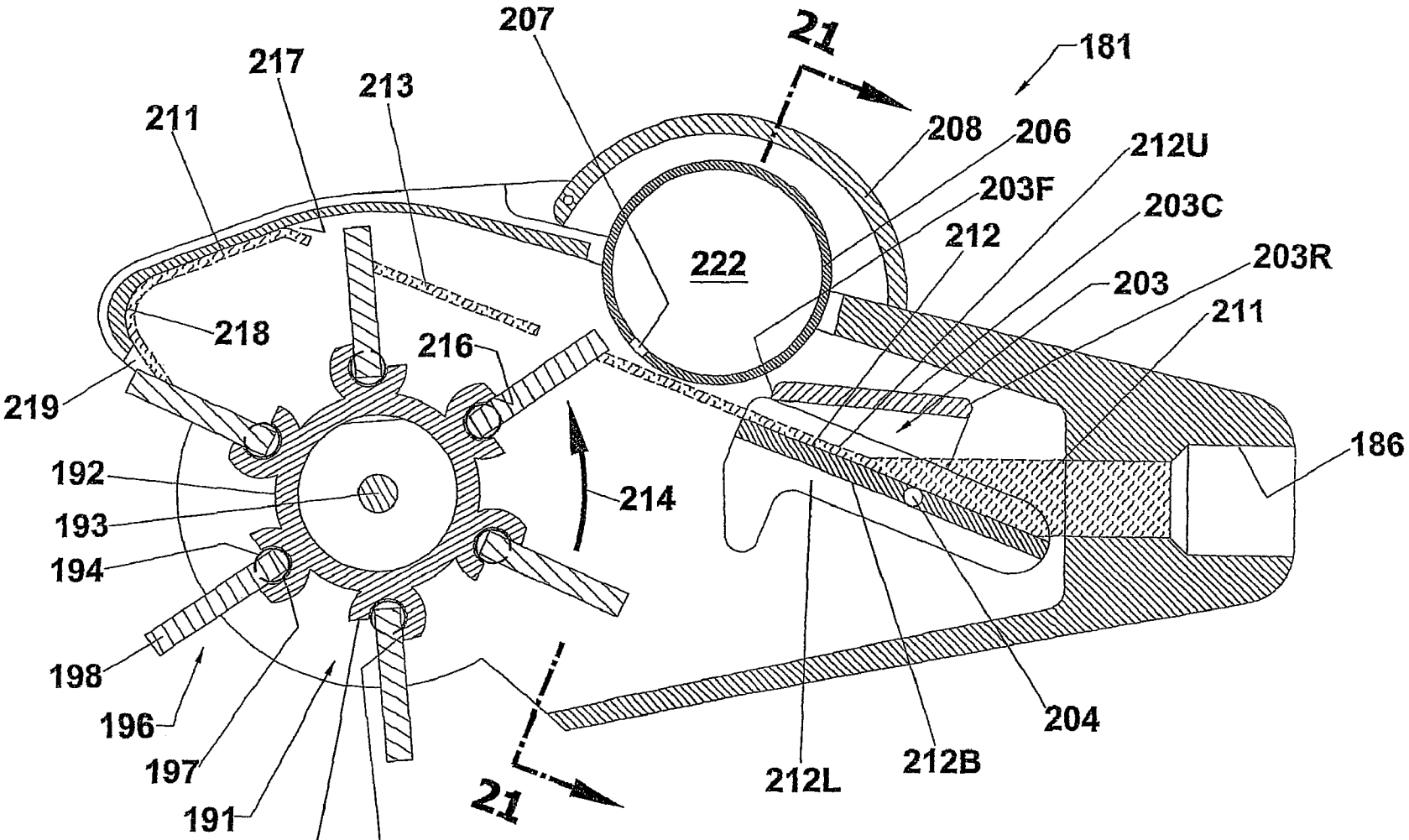
FIG. 20 is an enlarged section through this embodiment taken at line 20-20 in FIG. 18 and viewed in the direction of the arrows.
Figure 21:
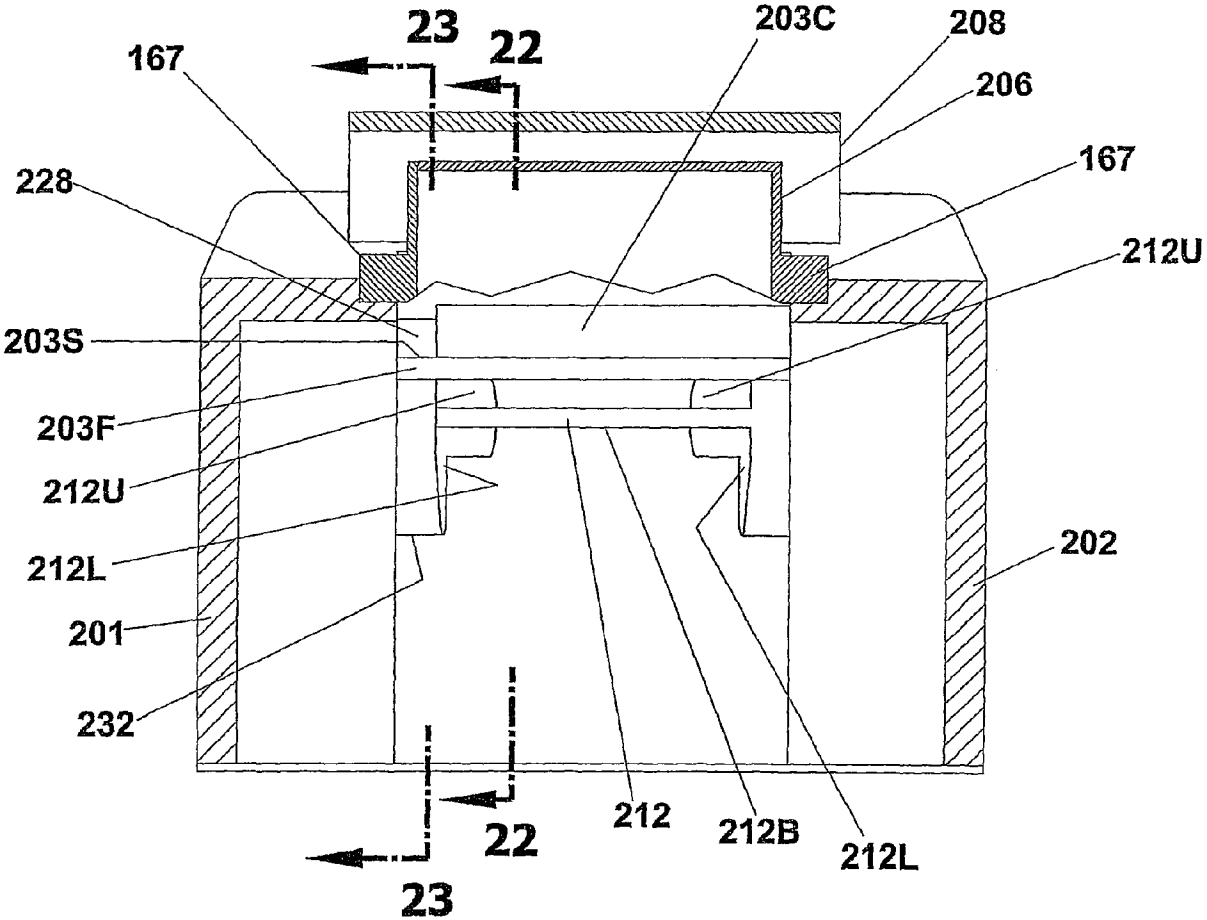
FIG. 21 is a cross-section thereof taken at line 21-21 in FIG. 20 and viewed in the direction of the arrows.
Figure 24:
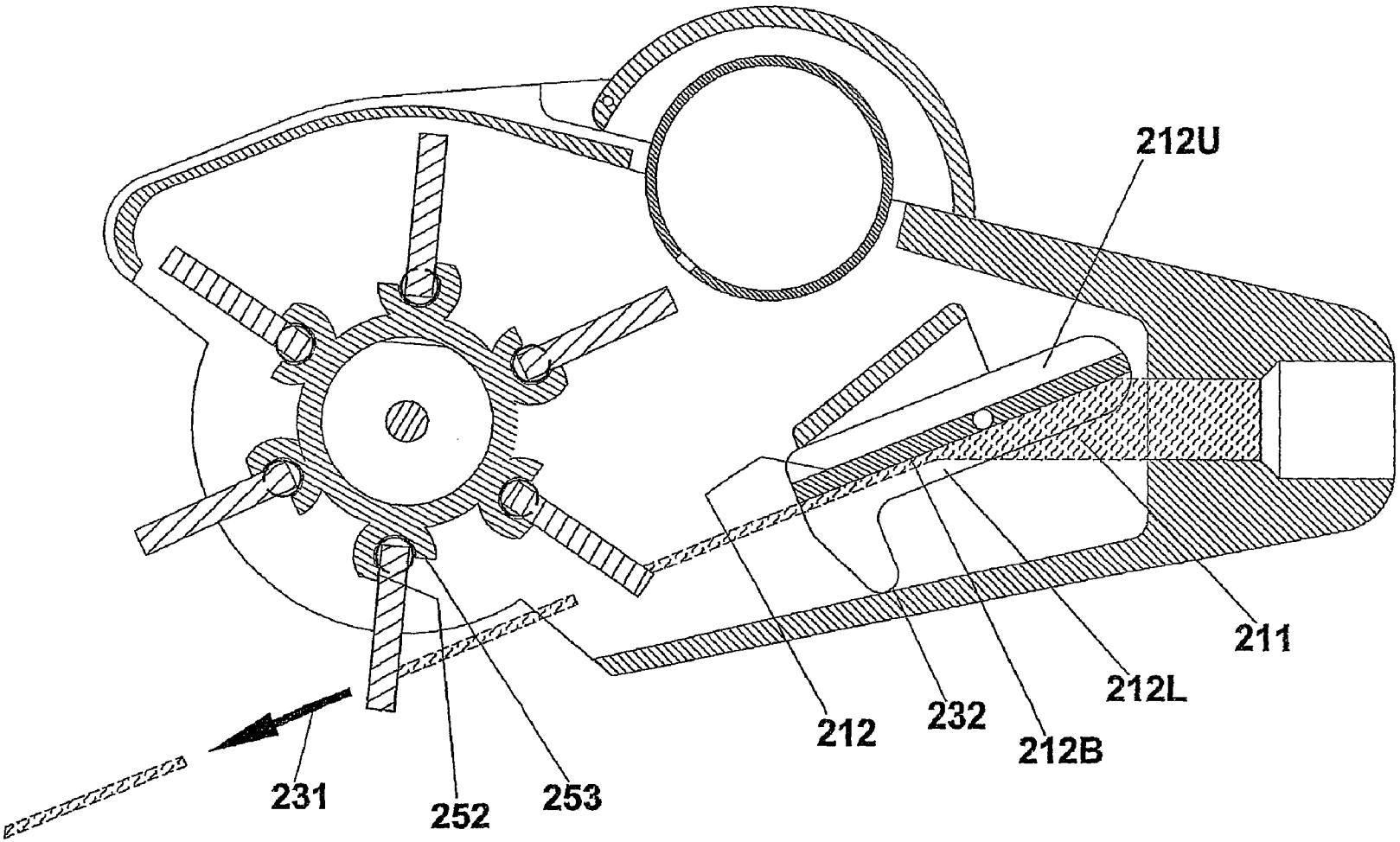
FIG. 24 is a view similar to FIG. 20 but showing the scrubber wheel and water discharge plate in a different attitude.

To direct the flow of pressurized water or other fluid introduced to the handle 184, there is a nozzle 203 pivotally mounted on an axle 204 in housing so that it is operable between a position shown in FIG. 20 and a position shown in FIG. 24. There is also a treatment material cartridge 206 mounted in the housing in the same manner as the cartridge 166 is mounted in the housing of the previously described embodiment. The cartridge also has an outlet aperture 207, and the cartridge is normally covered with the lid 208 hinged to the housing.

In the position shown in FIG. 20, the nozzle redirects the pressurized fluid 211 entering from the handle 184, upward on the deflector wall 212 of the nozzle in a discharge direction 213 which engages the face of each of the treatment elements 198 adjacent the outer portion of each of the treatment elements, causing rotation of the wheel in the direction of the arrow 214. The high stop 216 on the wheel keeps the treatment element erect so that the fluid blast from the deflector wall along the line 213 produces a strong rotational force on the wheel.

As the scrubbing wheel spins, and the driving fluid 211 departs off the end of the treatment elements, the fluid strikes the inside face of the upper wall 217 of the housing and is deflected downward and into a reverse curve surface at the inside 218 of the front of the housing above the outlet 219. At the upper edge of the outlet, the direction of the remaining blast is downward and rearward against the face of the treatment element moving downward away from the top of the opening, providing additional thrust to the wheel for rotation in the direction of arrow 214. As in the previously described embodiments, the treatment element is able to pivot backward as it strikes the surface of whatever is being treated by the scrubbing machine. As soon as it departs that surface, it again moves outward under centrifugal force and ready for impact by the fluid stream along line 213 when the treatment element moves upward and forward in the housing as the wheel rotates forward in the direction of arrow 214.

Figure 22:
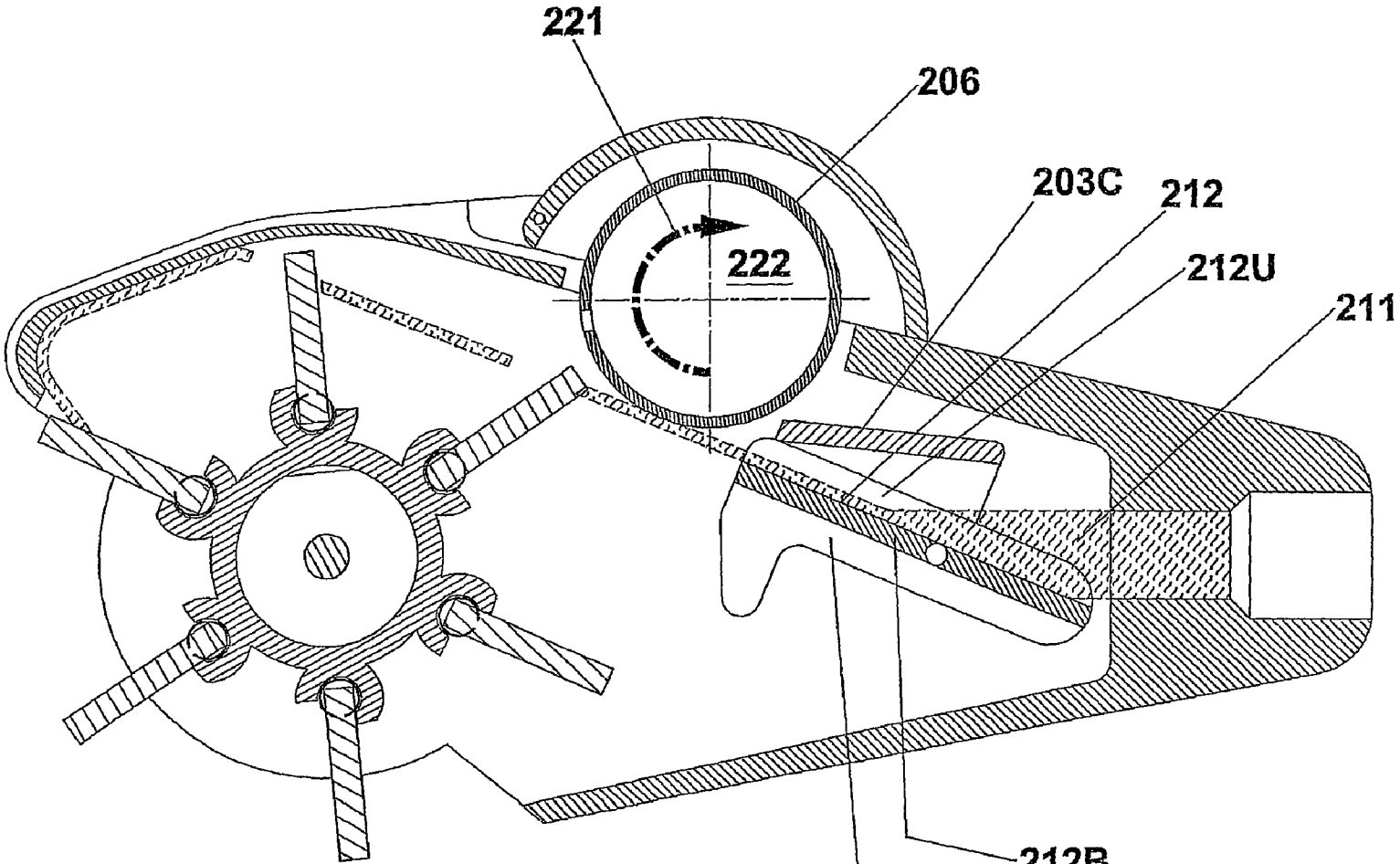
FIG. 22 is a section taken at line 22-22 in FIG. 21, viewed in the direction of the arrows and showing a change in operating state from that in FIG. 20.

To cause the treatment material dispenser cartridge to spin to discharge treatment material into the flow of fluid from the deflector wall 212, it is only necessary to tip the nozzle slightly clockwise to move the fluid discharge stream 213 of the nozzle from close proximity to the cartridge surface as in FIG. 20, to contact with the cartridge surface as in FIG. 22, where the stream engaging the perimeter of the cartridge spins the cartridge in the clockwise direction of arrow 221. The speed of rotation and the consequent amount of treatment material 222 discharged from the cartridge, will depend on how the fluid is striking the periphery of the cartridge.

Figure 19:
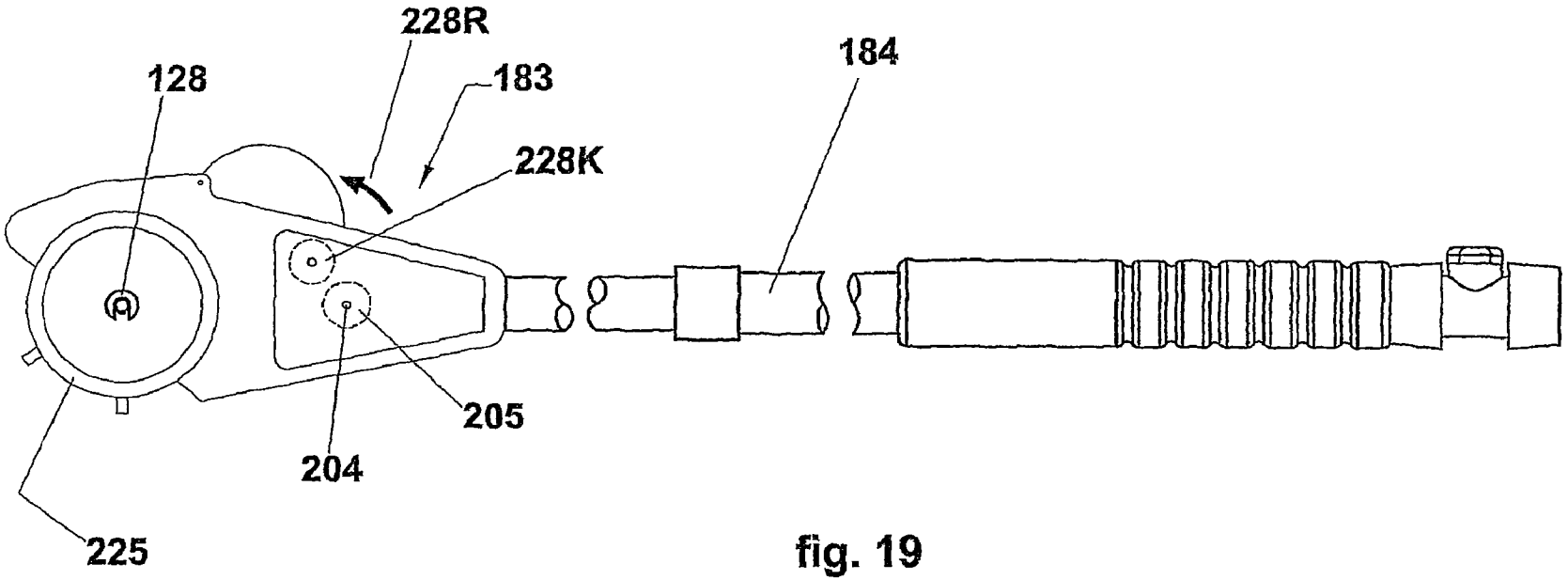
FIG. 19 is a side elevation view thereof.

Referring back to FIGS. 18 and 19, wheels 225 are mounted on axle 129 and held on by clips 128. These can be used conveniently as tires to rest and roll along the surface of an automobile being treated. They are bushed on the axle similar to the scrubber wheel mounting on the axle to turn relative to the axle, so the axle can be snug and need not turn in the mounting holes in the housing. It is preferable that the perimeter of the wheels be a flexible material of low friction to avoid a tendency to stick or otherwise scuff the surface being treated. Polyethylene has been found suitable, but other materials may serve as well.

Figure 23:
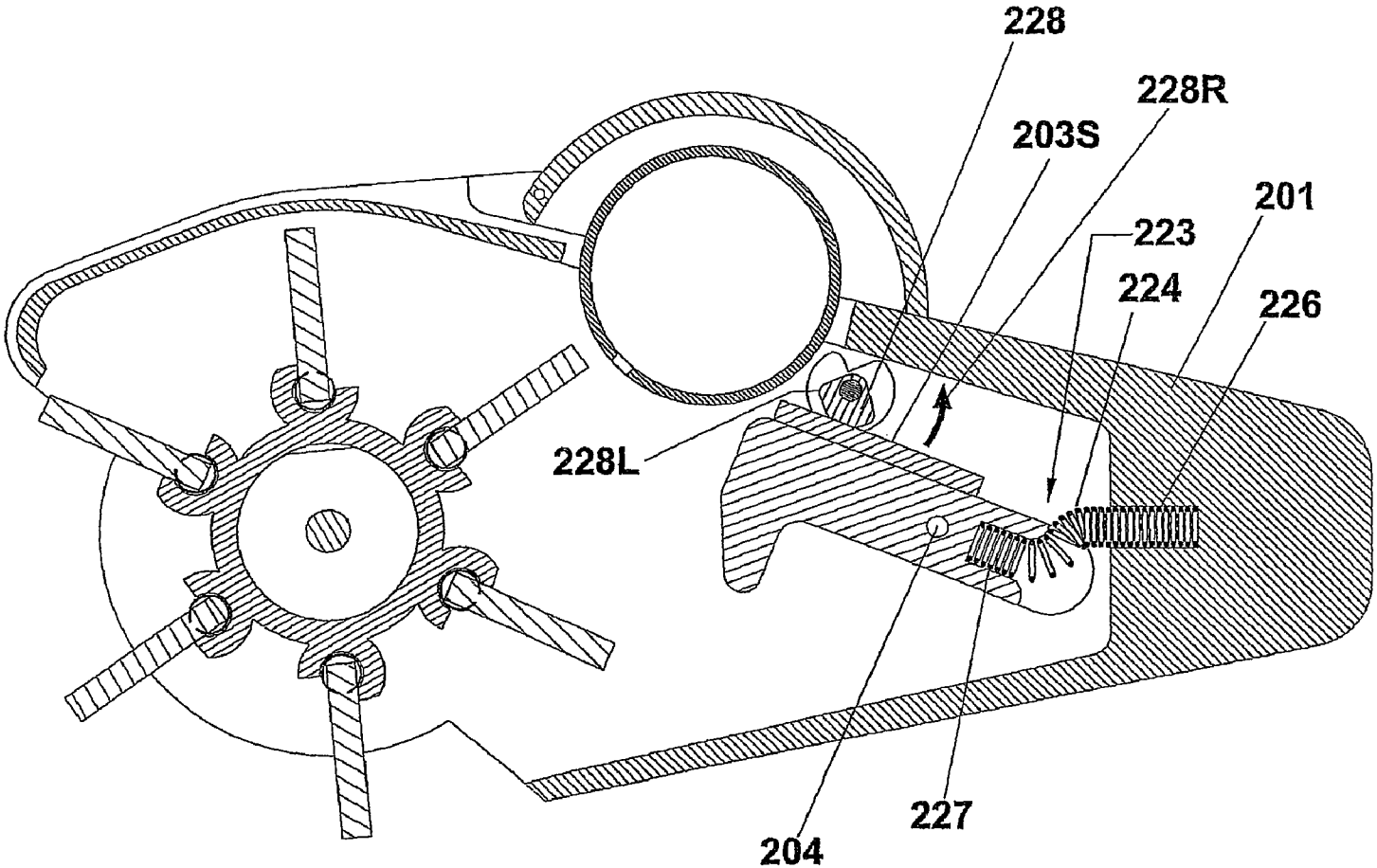
FIG. 23 is a section taken at line 23-23 in FIGS. 18 and 21 viewed in the direction of the arrows and showing the water discharge plate position stabilizer.

Referring now to FIG. 23, cam 228 engages ledge 203S on the nozzle, holding it in the position shown in FIGS. 20 and 23. The nozzle stabilizer 223 includes a spring 224 which has one end received in the socket 226 in the housing and the other end received in a socket 227 in the nozzle. This spring will hold the nozzle against the cam 228 in the attitude shown in FIG. 23. Turning the cam control knob slightly in the direction of arrow 228R will place a lower face 228L of the cam against ledge 203S of the nozzle, permitting the spring to tilt the nozzle to the position of FIG. 22 and spin the cartridge.

Figure 25:
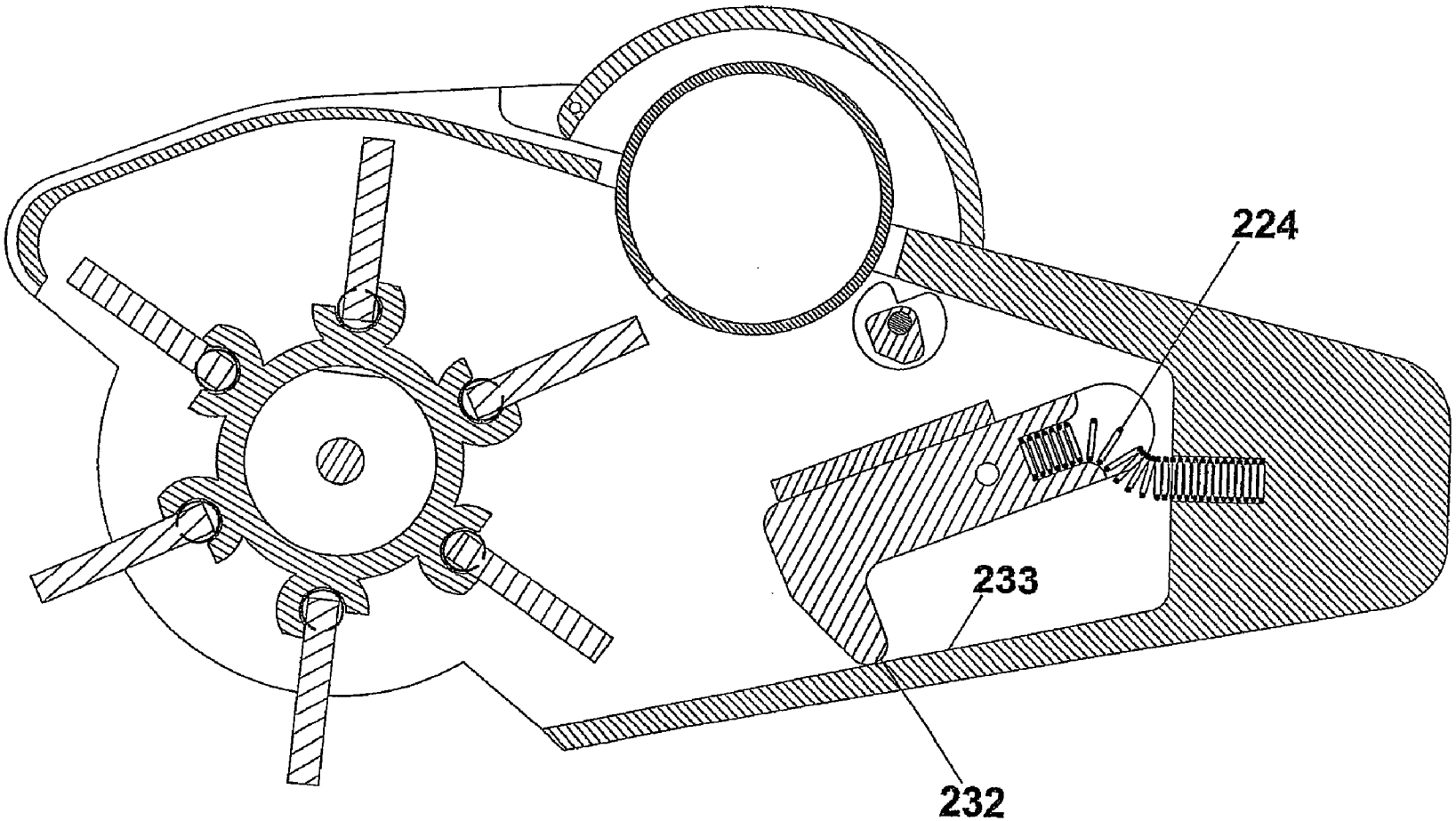
FIG. 25 is a view similar to FIG. 23 but showing the discharge stabilizer spring holding the stabilizer in the position shown in FIG. 24.

FIG. 24 shows the nozzle tilted downward whereby the fluid discharged from nozzle 203 is downward and forward in the direction of arrow 231. This is done by turning knob 205 (FIG. 18 and shown in dashed lines in FIG. 19 because it is on housing side 201) in the direction of arrow 228R. Fastened to the shaft 204, the knob turns the nozzle down so the bottom 212B of nozzle wall 212 intercepts the incoming fluid stream. During this shift of the nozzle, the spring seat in the nozzle moves above center of the seat in the housing so now the spring will maintain this nozzle attitude even if the fluid supply is shut off from the tool. Reverse turn of the knob 205 can return the nozzle to the FIG. 20-23 attitude. The FIG. 24 attitude is useful if the operator of the tool does not want any of the scrubbing solution to come backward as the tool is moved forward over the surface to be treated. For this purpose it will be noted that the scrubbing wheel is installed with the pivot stops such as 252, 253, facing the direction opposite of what they were in the examples of FIGS. 20 and 23. The stabilizing spring maintains the downward attitude of the deflector for this operation. The nozzle tip 232 is stopped on the bottom interior wall 233 of the housing as shown in FIG. 25.

Figure 26:
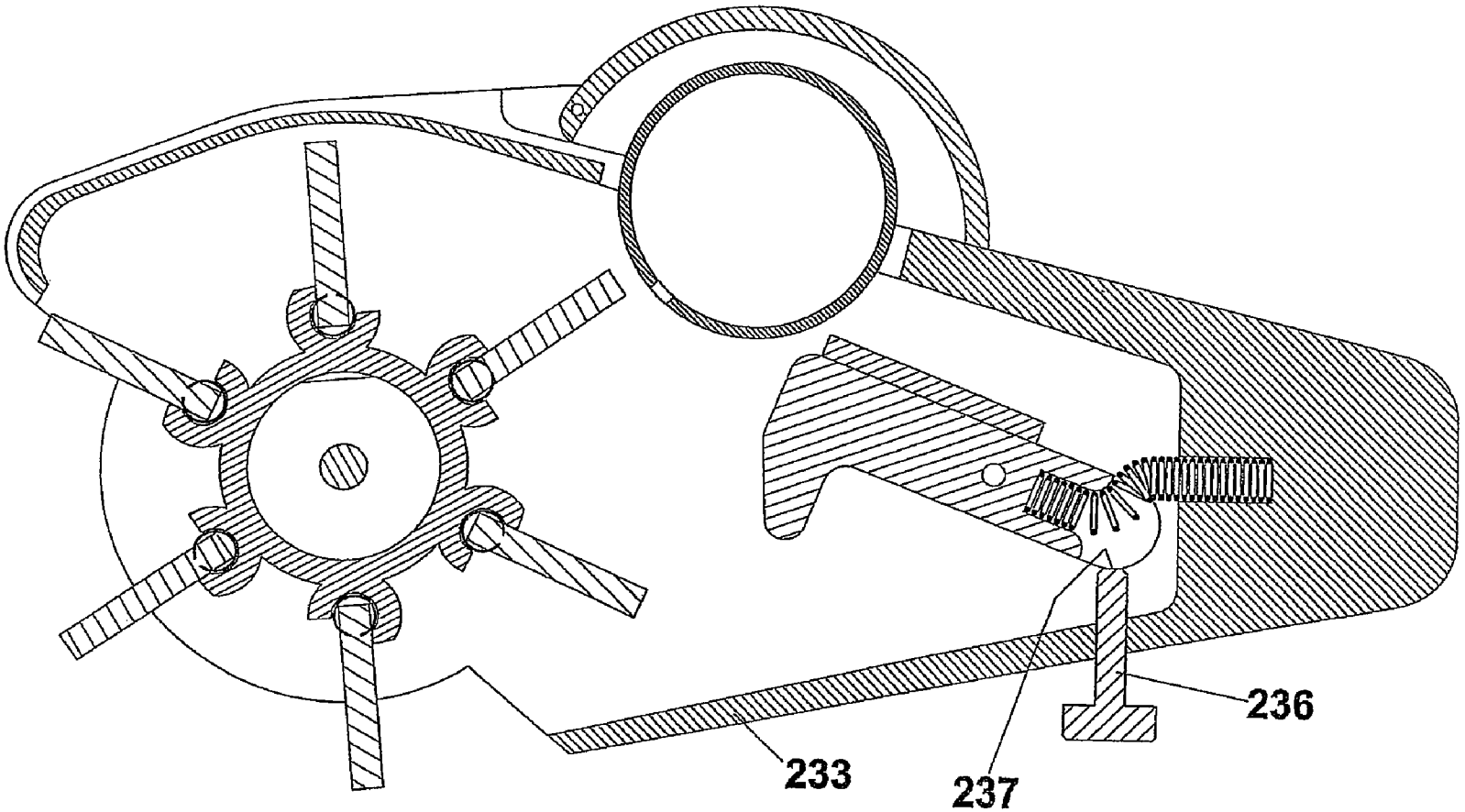
FIG. 26 is a view similar to FIG. 23 and showing an adjustable screw pivot stop for the nozzle discharge direction deflector plate adjustment screw.

FIG. 26 shows an adjustment screw 236 threaded into the bottom wall 233 of the housing. The tip 237 of the screw engages the bottom rear side of the nozzle and enables fine adjustment of nozzle angle if that is preferred over the use of the cam alone for controlling spin of the cartridge 206.

Figure 27:
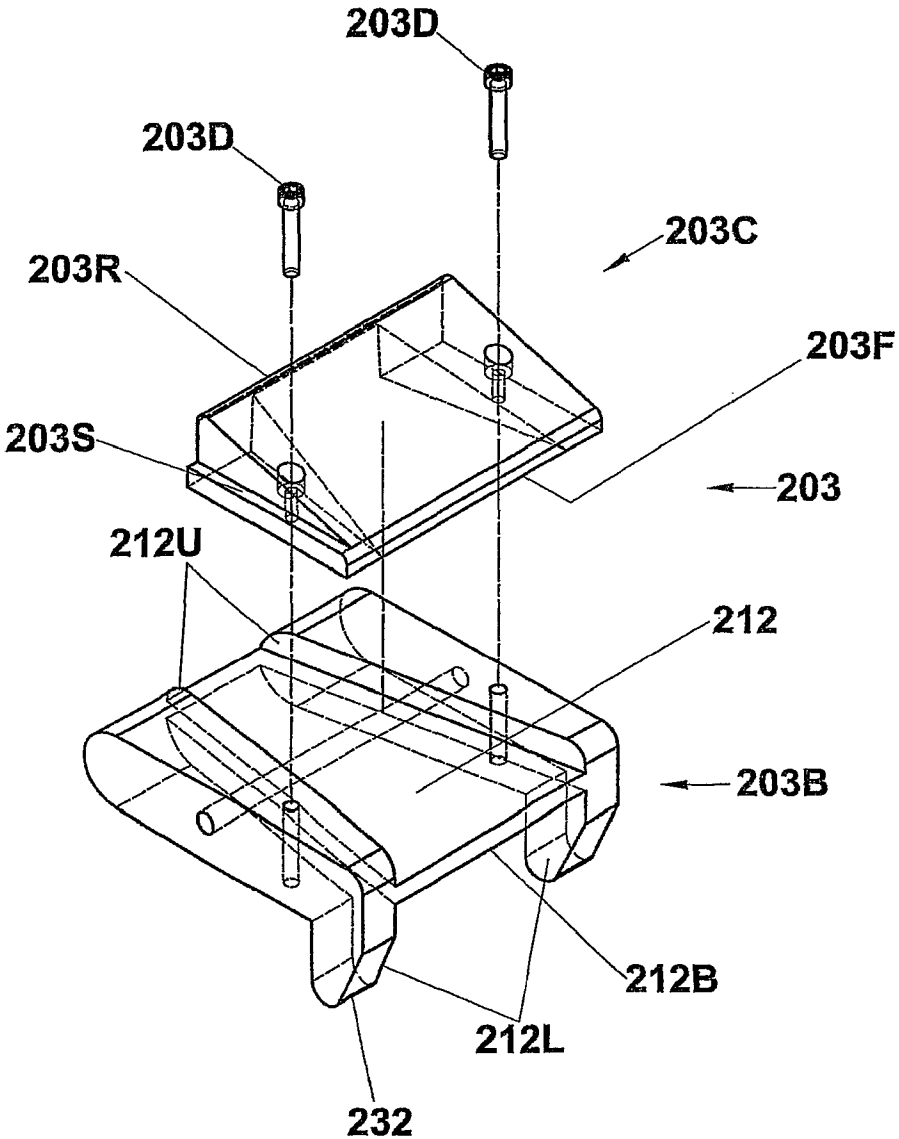
FIG. 27 is an exploded view of the nozzle deflector plate and deflector cap.

Referring now to FIG. 27, together along with FIGS. 20-26, this exploded view of nozzle 203 shows deflector plate portion 203B and deflector cap portion 203C. These parts are fastened together by screws 203D. The sides of the deflector plate 203B portion of the nozzle and which are bridged by the wall 212 have inside faces 212U above and 212L below the wall 212. These are flared outward as best shown in FIG. 27 to receive the pressurized fluid 211 entering the housing at the rear end of the nozzle. Therefore, when the nozzle is directed upward as in FIGS. 20-23, the entering stream 211 can spread laterally the width of the treating elements 198 on the wheel. The cap portion 203C of the nozzle slopes downward and forward from the rear edge 203R to the front edge 203F, across the width of the nozzle, converging toward the front of the nozzle, to avoid any overspray from the incoming stream 211 from spinning of the cartridge 206 when it is not desired, as in the nozzle position FIG. 20.

One example of the treatment material is a material known as Scotch-Brite®. The treatment portions of the scrubbing elements may be, for example, pads with any desirable "grit" of Scotch-Brite®. The material needs to be sufficiently sturdy to be able to remain straight out when impacted by the blast from the different types of nozzles, particularly when wet with water. It has been found that some automobile floor carpeting media with a "terry cloth" covering applied to it works well for some scrubbing applications using water as the carrier medium for washing with soap or other cleaning material in the cartridge, or as the carrier medium for polishing and/or waxing with a liquid wax in the replaceable cartridge. The cartridge could be a refillable type, but it is considered preferable that it be a single-fill, disposable, "throwaway" item after contents have been used.

While the various embodiments have multiple applications for scrubbing, polishing, waxing, or other treatment of a surface, it might be found more attractive to use the version shown in FIGS. 8-17 with the integral handle for smaller size job. As an example, that embodiment may have a handle 1½ inches wide and a 2 inch diameter wheel. The embodiment of FIGS. 18-25 might have a 4 inch diameter wheel about 5 inches wide with a screw-on water delivery handle 4 feet long. Thus, the larger size may be preferred for larger areas such as decks and building windows. The apparatus has a great variety of possible uses. In appropriate sizes and materials, it may also be used for washing or scrubbing hair or for skin exfoliation. While the term "scrubber" or "scrubbing" or the like has been used frequently herein, it should be interpreted broadly, as the apparatus is clearly adaptable to a variety of types of treatment of a variety of types surfaces.

While various embodiments of the invention have been illustrated and described in detail in the drawings and foregoing description, the same is to be considered as illustrative and not restrictive in character, it being understood that all changes and modifications that come within the spirit of the invention are desired to be protected.

What is claimed is:

1. A portable apparatus for treating a surface and comprising:

a handle having a proximal portion for holding in a person's hand and a distal portion for delivering a carrier fluid to the surface;

a carrier fluid supply fitting at the proximal portion for connection to a source of carrier fluid;

a housing at the distal portion of the handle;

a treatment material cartridge mounted on said housing for rotation on an axis in said housing and containing treatment material in liquid form, said cartridge having an outlet opening;

a nozzle at the housing, said nozzle having an inlet to receive said carrier fluid, and said nozzle having an outlet to discharge said carrier fluid;

a carrier fluid delivery passageway from said supply fitting to said nozzle inlet; and wherein:

said nozzle is movable to change direction of discharge of carrier fluid from said nozzle outlet relative to said axis.

2. The apparatus of claim 1 and wherein:

said passageway is a fluid delivery tube from said supply fitting to said nozzle;

the apparatus further comprising:

means associated with said nozzle to move said nozzle to change said direction of discharge from a direction initiating rotation of said cartridge on said axis to a discharge direction permitting rotation of said cartridge to cease.

3. The apparatus of claim 2 and further comprising:

a wheel mounted in the housing for rotation on a second axis in the housing;

a plurality of surface treating elements circularly spaced around the wheel; and wherein:

said nozzle is sufficiently movable to cause the discharge direction of carrier fluid from said outlet to impinge said treating elements and thereby rotate said wheel on said second axis.

4. The apparatus of claim 3 and wherein:

said nozzle and said cartridge and said wheel are arranged to enable a discharge direction of said carrier fluid to impinge portions of said cartridge and said treating elements to enable simultaneous rotation of said cartridge and said treating elements on their respective axes.

5. The apparatus of claim 4 and wherein:

said means associated with said nozzle to move said nozzle outlet to change the discharge direction from a direction initiating rotation of said cartridge on said axis to a direction permitting rotation to cease, are operable to move said nozzle to change the discharge direction to change the speeds of rotation of said cartridge and said wheel.

6. The apparatus of claim 5 and wherein:

said outlet opening on said cartridge is located on said cartridge in a position for discharging treatment material liquid from inside said cartridge as said cartridge rotates.

7. The apparatus of claim 6 and wherein:

the location of said opening on said cartridge is such that the rate of discharge of treatment material liquid from inside said cartridge increases as said cartridge is rotated at a higher rate of speed.

8. The apparatus of claim 4 and wherein said means associated include:

a cam mounted to pivot in said housing and operable on said nozzle to move said nozzle to change the rotational speeds of said cartridge and said wheel; and a manipulator outside said housing and coupled to said cam for moving said cam to adjust said nozzle to at least one or another of two different discharge directions.

9. The apparatus of claim 8 and wherein:

said nozzle is related to said cam and wheel and cartridge such that, said two different discharge directions from said nozzle pass between said axes.

10. The apparatus of claim 8 and wherein:

said nozzle is related to said cam and wheel and cartridge such that said manipulator is operable to move said nozzle such that in at least one of said two discharge directions, the discharge direction of carrier fluid from said nozzle is below both axes.

11. The apparatus of claim 10 and wherein:

said surface treating elements are arranged on said wheel such that those elements exposed below both of said axes pass are impinged by said carrier fluid and rotate said wheel on said second axis in a direction opposite the direction of rotation of said wheel when said discharge direction is above said second axis.

12. The apparatus of claim 8 and wherein:

said nozzle is related to said cam, and the viscosity of the treatment material liquid in the cartridge, are such that, in at least one of said two nozzle discharge directions, the carrier liquid discharged from said nozzle is insufficient to rotate said cartridge.

13. The apparatus of claim 8 and wherein:

said delivery tube is bendable by said cam to change said discharge direction.

14. The apparatus of claim 13 and wherein:

said supply fitting is adapted to connection to a conventional garden water hose for use of water as the carrier fluid.

15. The apparatus of claim 1 and wherein:

said cartridge is a single-fill disposable cartridge.

16. A portable apparatus for treating a surface and comprising:

a handle having a proximal portion for holding in a person's hand and a distal portion for delivering a mobilizing fluid to the surface;

a fluid supply fitting at the proximal portion for connection to a source of mobilizing fluid;

a housing at the distal portion of the handle;

a wheel mounted in the housing for rotation on an axis in the housing;

a plurality of surface treating elements circularly spaced around the wheel;

a nozzle at the housing, said nozzle having an inlet to receive said mobilizing fluid, and said nozzle having an outlet to discharge said mobilizing fluid in a direction; and a mobilizing fluid delivery passageway from said supply fitting to said nozzle inlet; and wherein:

said nozzle is movable to change discharge direction of said mobilizing fluid from said nozzle outlet relative to said axis, the apparatus further comprising:

a cam mounted to pivot in said housing and operable on said nozzle to move said nozzle to one orientation to establish one mobilizing fluid discharge direction to impinge said treating elements above said axis of rotation and thereby rotate said wheel in one rotational direction on said axis, and to move said nozzle to another orientation to establish another mobilizing fluid discharge direction to impinge said treating elements below said axis of rotation and thereby rotate said wheel in a rotational direction opposite said one rotational direction.

17. The apparatus of claim 16 and wherein:

said treating elements have a front face and a back face bordered by edges and are mounted on said wheel and pivotal between an extended outward condition relative to said axis with said back face oriented facing said nozzle when said nozzle is in said one orientation, and a collapsed condition upon impact with a surface being treated, said treating elements being supported by stops on said wheel engage-able by said front face of said treating elements to prevent said treating elements from being collapsed by impact of said fluid impingement from said nozzle on said back face.

18. The apparatus of claim 17 and wherein:

said wheel is adapted to reverse installation in said housing to place said back faces oriented facing said nozzle when said nozzle is in said another orientation to establish another mobilizing fluid discharge direction to impinge said treating elements below said axis of rotation and thereby rotate said wheel in a rotational direction opposite said one rotational direction.

19. The apparatus of claim 16 and wherein:

said nozzle has a deflector plate portion which has a rear end and a front end, said rear end at said nozzle inlet and said front end facing said wheel;

said nozzle has a cap portion covering said plate portion and which has a rear end and a front end, said rear end at said nozzle inlet and said front end facing said wheel;

said deflector plate portion having a top surface receiving said mobilizing fluid entering said housing from said passageway, and directing said received fluid toward said wheel above said axis when said nozzle is in said one orientation; and said deflector plate portion having a bottom surface receiving said mobilizing fluid entering said housing from said passageway when said nozzle is in said another orientation and directing said received fluid toward said wheel below said axis.

20. The apparatus of claim 19 and further comprising:

sidewalls above and below said deflector plate portion.

21. The apparatus of claim 20 and wherein:

said sidewalls flare out from said rear end of said deflector plate portion to said front end.

22. The apparatus of claim 21 and wherein:

said cap portion converges toward said deflector plate portion from said rear end of said cap portion to said front end of said cap portion.

23. The apparatus of claim 16 and wherein:

said nozzle is spring loaded for stabilization of said nozzle in said one orientation and, alternatively, in said another orientation.

24. A combination, comprising:

a portable scrubbing apparatus having a handle with a proximal portion and a distal portion;

a housing at said distal portion, said housing having a front opening with an upper edge;

a scrubber wheel rotatably mounted in said housing behind said front opening and which has a plurality of circularly-spaced surface-treating elements;

a nozzle for delivering fluid in one direction to said wheel, whereby said fluid rotates said wheel in one rotational direction relative to handle;

an interior surface in said housing and facing said nozzle and receiving fluid delivered in said one direction to said wheel and guiding said fluid toward said treating elements along said surface toward said upper edge of said opening; wherein:

said surface is shaped to deliver received fluid downward in another direction to said treating elements from said upper edge to assist said rotation of wheel in said one rotational direction; and a treatment material dispenser mounted on said housing for rotation on an axis in said housing and configured to contain treatment material in liquid form, said treatment material dispenser having at least one treatment material outlet opening; and wherein:

said nozzle has an outlet which is movable to change direction of said fluid from said nozzle outlet to said wheel and to rotate said treatment material dispenser while said fluid rotates said wheel in said one direction, to dispense treatment material from said treatment material dispenser.

25. The combination of claim 24 and, further comprising:

a high pressure water washer device coupled to said handle to deliver pressurized water to said nozzle.

26. The combination of claim 24 and wherein:

said treatment material dispenser is a single-fill disposable cartridge.

27. The combination of claim 26 and further comprising:

a cover on top of said housing and covering said cartridge; and wherein:

said cartridge has mounting posts;

said housing has a top surface with recesses receiving said mounting posts to support said cartridge for rotation on said housing; and said cover has recesses cooperating with said recesses on said housing to retain said posts while said cover is covering said cartridge.

28. The combination of claim 27 and wherein:

said cover is spring-loaded to hold said cover in position covering and retaining said cartridge in position for rotation on said housing; and said cover is operable to be opened by pivoting against said spring-loading to remove and dispose said cartridge when empty and replace with a new cartridge.

* * * * *